US006234259B1

(12) United States Patent
Kuckes et al.

(10) Patent No.: US 6,234,259 B1
(45) Date of Patent: May 22, 2001

(54) MULTIPLE CAM DIRECTIONAL CONTROLLER FOR STEERABLE ROTARY DRILL

(75) Inventors: Arthur F. Kuckes; Rahn Pitzer, both of Ithaca, NY (US)

(73) Assignee: Vector Magnetics Inc., Ithaca, NY (US)

( * ) Notice: Subject to any disclaimer, the term of this patent is extended or adjusted under 35 U.S.C. 154(b) by 0 days.

(21) Appl. No.: 09/305,439

(22) Filed: May 6, 1999

(51) Int. Cl.[7] ..... E21B 7/06
(52) U.S. Cl. ..... 175/73; 175/61
(58) Field of Search ..... 175/24, 26, 55, 175/61, 73, 76; 166/66.4

(56) References Cited

U.S. PATENT DOCUMENTS

| | | | | |
|---|---|---|---|---|
| 2,745,635 | | 5/1956 | Zublin . | |
| 2,891,769 | | 6/1959 | Page et al. . | |
| 3,043,381 | | 7/1962 | McNeely | 175/73 |
| 4,076,084 | * | 2/1978 | Tighe | 175/73 |
| 4,120,097 | * | 10/1978 | Jeter | 175/45 |
| 4,200,213 | | 4/1980 | Liesse | 227/10 |
| 4,303,135 | * | 12/1981 | Benoit | 175/73 |
| 4,319,649 | | 3/1982 | Jeter | 175/73 |
| 4,501,336 | | 2/1985 | Kemp | 175/61 |
| 4,729,438 | | 3/1988 | Walker et al. | 175/76 |
| 4,739,842 | | 4/1988 | Kruger et al. | 175/61 |
| 4,770,258 | * | 9/1988 | Falgout, Sr. | 175/73 |
| 5,133,418 | | 7/1992 | Gibson et al. | 175/45 |
| 5,307,885 | | 5/1994 | Kuwana et al. | 175/26 |
| 5,316,090 | | 5/1994 | Kuwana et al. | 175/24 |
| 5,353,884 | | 10/1994 | Misawa et al. | 175/26 |
| 5,547,031 | * | 8/1996 | Warren et al. | 175/73 |
| 5,875,859 | * | 3/1999 | Ikeda et al. | 175/73 |

* cited by examiner

*Primary Examiner*—Robert E. Pezzuto
*Assistant Examiner*—Nathan Mammen
(74) *Attorney, Agent, or Firm*—Jones, Tullar & Cooper, PC

(57) ABSTRACT

A directional drilling control system for a drill stem carrying a conventional drilling head includes an elongated actuator housing fixed in a borehole being drilled. The drill stem passes through the housing and is generally coaxial with it, and an actuator within the housing is selectively activated to deflect the drill stem with respect to the axis of the housing. The actuator is selectively driven to regulate the direction and amount of deflection to thereby control the direction of drilling. An electrical controller in the housing in communication with a surface controller and/or with feedback sensors in the housing controls the actuator.

28 Claims, 12 Drawing Sheets

MULTIPLE CAM DIRECTIONAL CONTROLLER FOR STEERABLE ROTARY DRILL

BACKGROUND OF THE INVENTION

The present invention relates, in general, to a method and apparatus for controlling the direction of drilling a borehole. More particularly, the invention is directed to a method and apparatus for controlling the bending of a rotary drill stem with respect to the borehole to control the direction of drilling, and still more particularly to a multiple cam actuator for producing an accurate and controlled bending of a rotary drill stem.

One commonly-used method for controlling the direction of drilling a borehole is to utilize a "bent sub" at the bottom end of a drill stem, with a hydraulically-driven motor being mounted on the bent sub for operating the drill head. The bent sub positions the axis of the drill bit at a slight angle with respect to the axis of the drill stem and the hydraulic motor drives the drill bit at the angle of the bent sub, for example, at an angle of about one degree from the axis of the drill stem. The drill advances in the direction of the bend, thereby causing the borehole to curve in the direction of the bent sub and the angular position of the drill stem controls the angular direction of the curve. To drill a straight hole, the drill stem is continuously rotated while the drill bit is driven to thereby rotate the direction of the bent sub around the axis of the drill stem. This makes a slightly larger borehole, but causes it to be drilled in a straight line.

Alternatives to the foregoing technique for directional drilling include the technique described in British Patent 2,177,738, published Aug. 3, 1988. This patent discloses a steerable rotary drilling technique wherein a rotary drill stem passes through an enclosure tube, or housing, which is held against the sidewall of the borehole being drilled so that the tube does not rotate. Inside the tube, a system of hydraulically inflatable bags deflect, and thus bend, the drill stem in a controlled way with respect to the enclosure tube, and this bend causes the axis of the drill bit outside the housing to be angled with respect to the axis of the tube and thus of the borehole, causing the drill to advance in the direction of the bend to produce a curved borehole.

Another control mechanism for steerable rotary drilling systems is described in a publication of J. D. Barr et al entitled "Steerable Rotary Drilling with an Experimental System" presented at the 1995 SPE/IADC drilling conference held Feb. 28, 1995 (Paper Number SPE/IADC 29382). As there disclosed, a control mechanism selectively deflects drilling fluid against one of three radial pistons which extend out of the drill stem and against the wall of the borehole. The pistons are sequentially pushed outwardly as the drill stem rotates to press the drill stem away from a selected point on the borehole sidewall to thereby apply lateral force for steering the direction of drilling.

A third known control mechanism is illustrated in U.S. Pat. No. 5,168,941, wherein a stabilizer is anchored to the borehole wall. Drilling fluid actuates four pistons which press against the wall to adjust the location of the stem and to thereby apply lateral force to the drill bit to cause the borehole to curve.

Other control devices have been developed in the art to control drilling direction though the use of eccentric cams which bend the drill stem, as described, for example, in U.S. Pat. Nos. 5,307,885 and 5,316,090.

Each of the foregoing systems has been found to have problems, not only in producing an accurately controllable deflection in the drill stem, but in measuring the actual deflection produced by the control mechanism. Accordingly, there is a need for an improved control mechanism for directional drilling utilizing rotary drill stems.

SUMMARY OF THE INVENTION

Briefly, the present invention is directed to an improved steerable rotary drilling system having a directional controller mechanism incorporating a multiple cam actuator for bending a drill string to control its direction of drilling. In addition, the invention may include, in one embodiment, a detector mechanism for measuring the amount and direction of bending to provide feedback control of the drilling direction.

In general, the invention is directed to apparatus for controlling the direction of drilling in a borehole, and includes an elongated housing locatable in the borehole. A rotary drill stem extends coaxially through the housing and a first actuator set is mounted on the drill stem within the housing. A second actuator set is mounted on the drill stem adjacent the first actuator set, with actuators in the first and second sets being linked to each other for limited rotation relative to each other. Rotation of the drill stem causes the actuators to shift radially in opposite directions with respect to the axis of the drill stem to thereby shift the actuators alternately into and out of engagement with the housing to bend the drill stem with respect to the housing. Drivers are connected to selected actuators in each set to rotate them in order to change the bend in the drill stem.

In a preferred form of the invention, a directional controller mechanism for a rotary drill stem incorporates two axially spaced sets of actuators. These actuators preferably are coaxial, eccentric cams, and herein will be referred to as such, although it should be understood that the actuators can take other forms. Corresponding cams in the two sets are interconnected in pairs and are mounted on the drill stem to enable cams of one set to engage the interior of an elongated, directional enclosure tube, or control housing, surrounding a lower portion of the drill stem near its drill collar, while the cams of the other set are released from engagement. The control housing is located within the borehole being drilled, is restrained from rotating with respect to the borehole, and is secured at its upper and lower ends to the drill stem by suitable bearings which center the drill stem in the housing, with the actuator cams being located approximately midway between the housing ends. The cams are selectively rotatable with respect to the housing and the cams in at least some of the pairs of cams are rotatable with respect to each other. At least one cam engages the housing to shift the location of the drill stem laterally away from the axis of the housing, and thus of the borehole, to bend the portion of the drill stem which is in the housing. The bending of the drill stem causes the portions of the rotary drill stem which are outside the housing, and thus the drill bit carried by the drilling collar on the end of the drill string, to be angled with respect to the axis of the housing and the borehole, so that when the drill is operated, it tends to advance in the direction of the bend. By selective rotation of the cams, the desired amount and direction of borehole curvature can be obtained. To drill in a straight line, the cams are rotated to bring the axis of the drill stem into alignment with the axis of the housing, and thus of the borehole.

Preferably, two sets of side by side cams are provided, with each of the cams of one set being interconnected with a corresponding cam in the second set to form cam pairs. A first pair is fixedly mounted on the outer surface of, or is fabricated as a part of, the drill stem to rotate with the stem. The lobes of the first pair of cams are tiny, and their radii of greatest extension are offset 180° from each other. A second pair of cams is concentric with, and rotatably mounted on, the outer cam surfaces of corresponding cams of the first pair. The cams of the second pair are interconnected, or linked, so that their lobes are offset by an adjustable amount with respect to each other. A third or outer pair of cams are concentric with, and rotatably mounted on, the outer cam surfaces of corresponding cams of the second pair, with the cams of the third pair being interconnected so that their lobes are offset by an adjustable amount with respect to each other.

The first pair of eccentric cams is preferably integral with the drill stem and rotates with it to cyclically relax one set of cams to allow them to be rotated easily, while engaging the other set with the housing to cause that set to apply a force which provides the drill string bending load. The two cams of the second pair of eccentric cams are linked together for limited relative rotation with respect to each other, and each cam is driven by a corresponding driver such as a small electric motor or by a corresponding gear drive such as a worm gear which receives its power from the rotation of the drill stem. The cam of the second pair which is in the relaxed set is rotatable by its driver, while the cam of the second pair in the engaged set does not rotate because of the bending load on the drill stem. The two cams of the third pair of eccentric cams are also linked for limited relative rotation with respect to each other, and each of these cams is also driven by a corresponding driver such as a small electric motor or by a corresponding gear drive such as a worm gear which receives its power from the rotation of the drill stem. As was the case with the second pair, the cam of the third pair which is in the relaxed set is rotatable by its driver, while the cam of the third pair in the engaged set does not rotate because of the bending load it is applying on the drill stem.

The offset lobes of the first pair of cams ensure that the outer cam surface of at least one of the sets of cams engages the inner surface of the housing while the other set is disengaged, or relaxed, and is free to rotate a small amount. Thus, the outer surfaces of each of the first pair of cams engage the inner surfaces of corresponding cams of the second pair, with the offset lobes of the first pair shifting the two cams of the second pair in opposite directions, radially inwardly and outwardly with respect to each other as the drill stem rotates. This causes the corresponding cams of the third pair to shift radially inwardly and outwardly and causes the outer surface of first one and then the other of the corresponding cams of the third pair to disengage from the inner surface of the housing while the other engages the housing.

As the drill stem rotates to alternately engage and release the sets of cams, one cam of each pair is engaged and the other of each pair is disengaged. The disengaged cams can easily be incrementally rotated by their respective drivers; for example, in steps of up to about 3 degrees, the relative rotation of cams in a pair being limited by the linkage between them. The drill stem is shifted laterally with respect to the housing by the location of the engaged cams, while the disengaged cams can be rotated as desired to shift the amount and the direction in which the drill stem will be bent when the first pair of cams on the drill stem rotates to bring them into engagement with the housing. The rotation of the drill stem, and thus of the first pair of cams, causes first one and then the other set of cams to engage the housing, with the released cams being rotatable to adjust the direction of bend in incremental steps and to adjust the amount of bend in incremental steps by controlling the alignment of the lobes in the second and third pair of cams.

The cam drivers can be mechanically driven by the drill stem through a speed reducing power takeoff system which may be selectively coupled to the rotary drill stem by one or more electromagnetic or hydraulic clutches. In one embodiment, the power takeoff system operates through corresponding torque tubes, or drive tubes, which are in turn connected to the cams.

Since the cams are rotated when they are in their relaxed state, very little torque is required to drive them. As a result, small electric motors can be used to drive them, if desired, with the power being readily provided by an alternator coupled to and driven by the drill stem and controllable by suitable down hole electronics within the housing.

The drill operator can communicate with the down hole control electronics for the actuator sets in a number of ways; for example, by varying the rotational speed of the drill stem in predetermined, coded patterns, by mud pulsing, or by other known techniques. The down hole control electronics preferably includes an orientation package having magnetometers and accelerometers for measuring the borehole inclination, azimuth and housing roll angle, and switching electronics are provided to control the electromagnetic or hydraulic clutches or the electric drive motors for regulating the incremental motion of the second and third pairs of eccentric cams in response to commands from the operator.

The amount of force required to bend a conventional drill stem laterally within the housing by, for example, one half inch, is about 500 pounds, and an additional 1000 pounds lateral force on the drill bit is required. However, with the second and third pairs of cams being driven radially by the first pair of cams mounted on the drill stem to release first one set and then the other set of the cams in each of the second and third pairs, little rotational force is needed to position the second and third pairs of cams. This force is readily provided through a suitable speed reducing gear system or a small electric motor, as noted above.

A preferred detector mechanism for providing feedback control of the directional controller of the present invention includes four pickup coils spaced 90° apart around the rotary drill stem for sensing a permanent magnet mounted for rotation with the drill stem. The coils may be mounted on the housing surrounding the drill stem, preferably near the actuator, and each coil produces an output pulse as the permanent magnet passes it. The amplitudes of the output signals from opposed pairs of coils provide a measure of the distance of the drill stem from the coils, with one pair of coils measuring the distance on an X axis, while the other pair measures distance on a Y axis, thereby providing a measure of the amount and direction of the curvature of the axis of the drill stem with respect to the fixed housing.

Another suitable detector mechanism for measuring drill stem deflection is a counter to measure the rotation of the cams, as by counting the teeth on a ring gear carried by the corresponding drive tube, to provide a measure of the rotational position of each tube, and thus of the angular position of the corresponding eccentric cam. The direction of the drill stem bend can be calculated from the positions of the several cams. A similar counter can be provided on the drill stem to monitor its speed of rotation for use in detecting encoded information being transmitted from the surface by means of rotational speed variations.

Sensors preferably are provided in the directional control housing to measure various other parameters such as temperature, drilling fluid pressure, and the like. The magnetic pickup coils described above may also be used to measure the curvature of the drill stem when the actuator is not in use, to provide a measure of the curvature of the borehole in which the drill stem is located. This curvature, commonly referred to as "dogleg severity" is an extremely important drilling parameter, for it measures the deviation of the borehole, and thus its change in direction, over the distance between the ends of the fixed housing.

Data signals representing detector and sensor output signals may be transmitted to the surface by way of the down hole electronics and a suitable communication system. In one such system, the data signals are supplied to a solenoid antenna on the drill stem within the fixed housing. The solenoid produces a corresponding signal current on the drill stem which is sensed by a solenoid pickup coil surrounding the drill stem outside the housing. This pickup coil is coupled to a conventional data transmission system such as a mud pulser for transmission of the detector output signals to the earth's surface, where it is recorded and/or monitored by the drill operator. Control signals may be returned down hole by the same signal transmission path to the down hole electronics.

As is known in rotary drilling systems, drill bits are subject to lock-up during drilling, as where the drill bit engages a rock or other hard material to cause the drill to stop, causing twisting of the drill stem. The torque transmitted through the drill stem eventually causes the drill bit to release and resume rotation, and this is referred to as a "stick and release" operation. The rotational variations caused by this operation can be measured and can be superimposed on the rotational data so that these effects can be canceled out of the measured data.

In the present invention, the normal stick and release operation causes another problem, since the downhole electrical controls preferably are powered by a downhole electrical alternator driven by the rotation of the drill stem. Such an alternator will stop delivering electric power during sticking, but this can be overcome by the use of a flywheel connected to the alternator and driven by the drill stem through an overriding clutch. The flywheel continues to rotate even during sticking, or lock-up, to provide continuous operation of the alternator.

In another aspect of the invention, an improved alternator structure is provided, wherein the coils of the alternator extend in a direction parallel to the axis of the drill stem to reduce alternator diameter.

Another important aspect of the present invention is the provision of an adjustable oil seal at each end of the housing. The seal of the present invention is fixed with respect to the housing, but incorporates a sleeve which is attached to the rotating drill stem. The seal which is capable of permitting a small amount of radial motion of the drill stem due to bending by providing a rocking action to allow it to maintain contact with an elastomer ring seal. In addition, a pressure compensating boot may be provided within the housing to compensate for changes in oil volume and pressure due to temperature changes.

BRIEF DESCRIPTION OF THE DRAWINGS

The foregoing, and additional objects, features and advantages of the invention will be apparent to those of skill in the art from following detailed description of preferred embodiments thereof, taken in conjunction with the accompanying drawings, in which.

DESCRIPTION OF PREFERRED EMBODIMENTS

Figure 1:
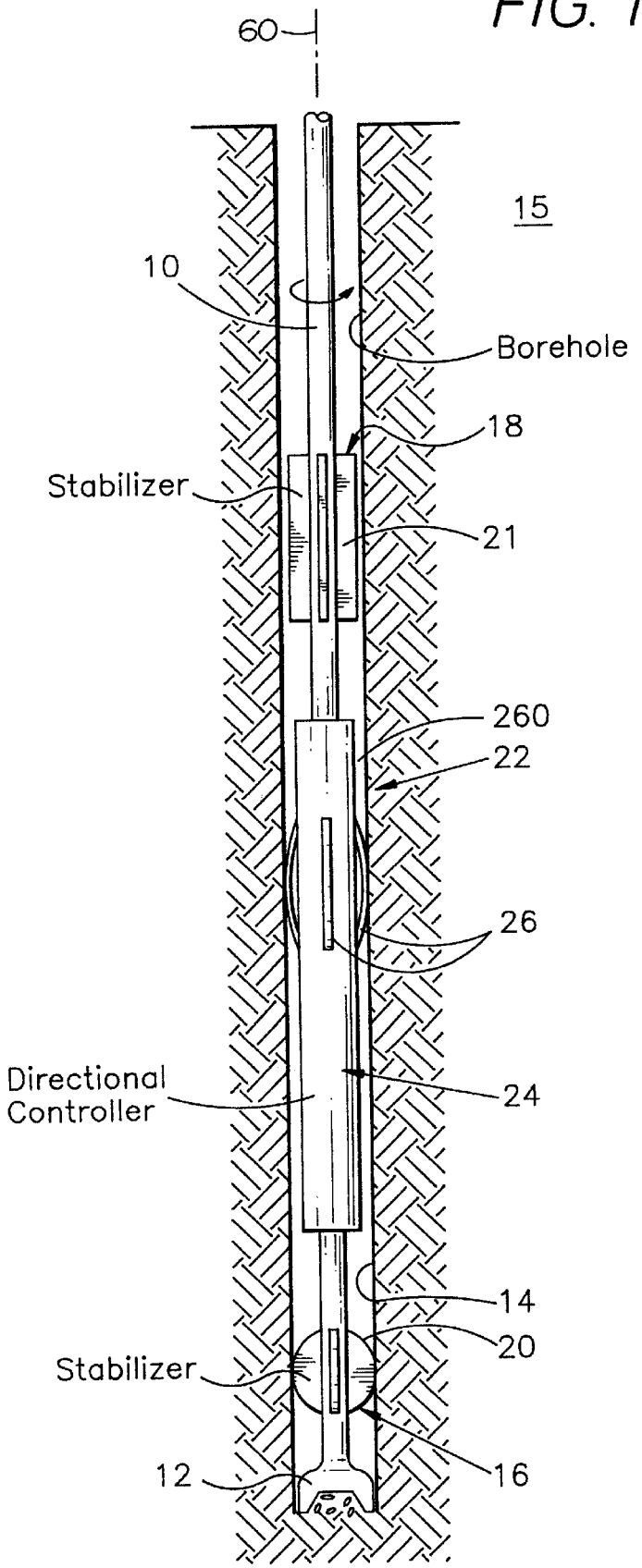
FIG. 1 is a diagrammatic illustration of a steerable drill stem incorporating a directional controller in accordance with a first embodiment of the present invention.

Referring now to FIG. 1, there is illustrated a rotary drill stem 10 carrying at its lower end a drill bit 12 which is driven by the stem to produce a borehole 14 in the earth 15. As is conventional, the drill stem may be centered in the borehole 14 by two spaced stabilizers; for example, a "watermelon" stabilizer 16 and a fin stabilizer 18. The stabilizer 16 may be located near the drill bit 12 and may include four stabilizer fins having curved outer edges 20 which engage the wall of borehole 14 and which allow the drill stem 10 to tilt in the borehole while still centering it. The upper stabilizer 18 similarly may include four spaced fins 21 which engage the wall of the borehole and center the stem. These stabilizers rotate with the drill stem and tend to clean out the borehole as the stem moves downwardly during drilling, while keeping the drill stem centered in the hole.

Located between the stabilizers 16 and 18 is a directional controller assembly 22 having a housing 24 which surrounds the drill stem. Preferably the housing includes a plurality of bowed springs 26 spaced around its exterior and engaging the wall of borehole 14 to prevent the controller assembly from rotating in the borehole. The controller housing 24 is secured at its upper and lower ends to the drill stem by suitable bearings to permit the drill stem to rotate with respect to it. The controller assembly 22 incorporates an actuator mechanism for deflecting the drill stem laterally in a selected direction and by a selected amount with respect to housing 24. This deflection places a slight bend or arc on the drill stem 10 so that the axis of rotation of the drill bit 12 is tilted with respect to the normal axis of the drill stem to cause the drill to operate at a slight angle with respect to the axis of the borehole. This causes of the drill to follow a path which is curved in a direction selected by the direction of the lateral displacement of the drill stem.

Figure 2A:
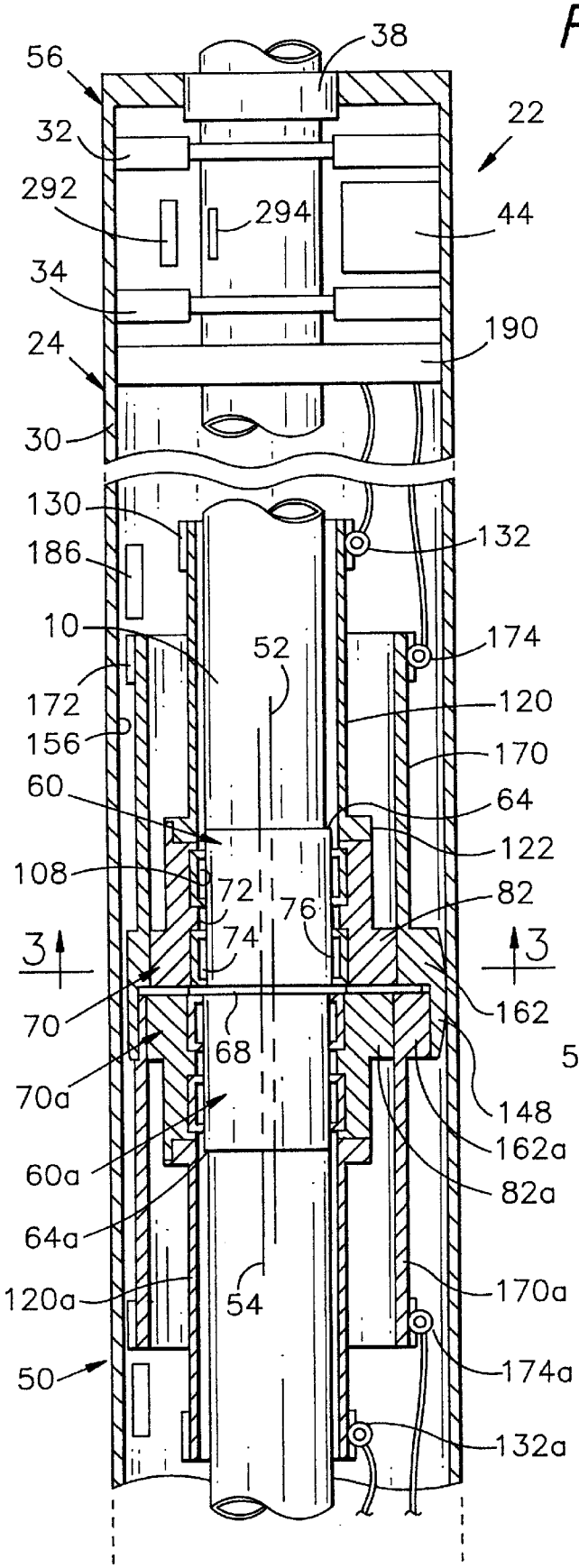
FIGS. 2A and 2B are an enlarged view in partial cross section of the directional controller of FIG. 1, illustrating the improved multiple cam actuator of the invention.
Figure 2B:
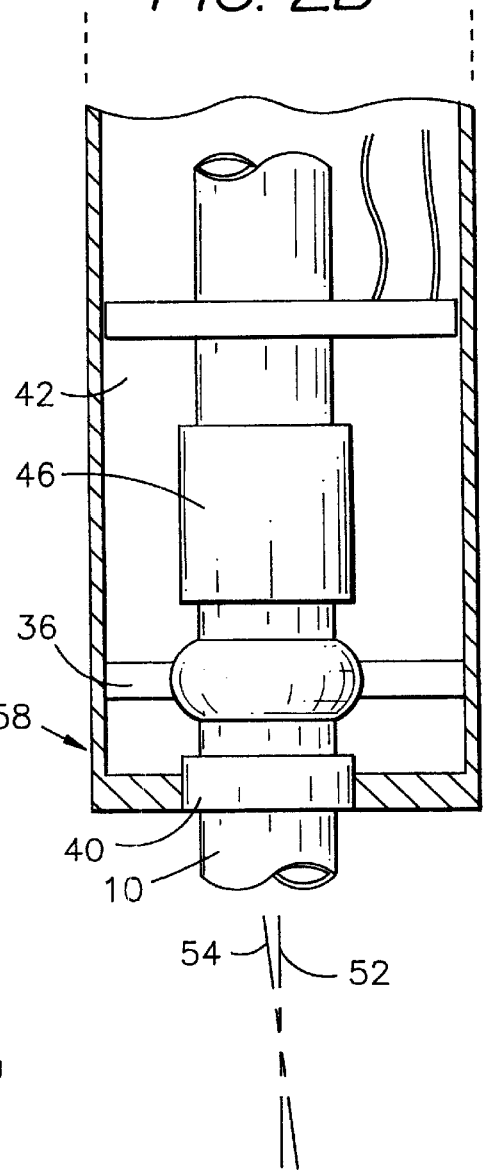

One form of the directional controller 22 is illustrated in the enlarged, diagrammatic, partial cross-sectional view of FIGS. 2A and 2B, to which reference is now made. It will be understood that the relative proportions of the components of the controller assembly have been exaggerated in order to illustrate the structural features of the invention. As illustrated, the controller assembly 22 includes the housing 24 which has a generally cylindrical sidewall 30 surrounding the drill stem 10. The housing 24 is supported on the drill stem by suitable upper bearings 32 and 34 and by lower bearings 36. Upper and lower oil seals 38 and 40 surround the rotary drill stem 10 at the top and bottom ends, respectively, of the housing so that the interior of the housing, generally indicated at 42, can be filled with oil to protect the components within the housing from the conventional drilling fluid (or mud) flowing through the borehole.

A control electronics package 44 is mounted within the housing 24 near the drill stem, and includes sensors for detecting and measuring rotation of the drill stem and the other parameters such as temperature, magnetic fields, gravity and the like. The package may include a suitable transmitter and receiver for communicating with control equipment at the surface, and incorporates suitable microprocessor controls responsive to received control signals for operating an actuator mechanism (to be described) within the housing to thereby control the curvature in the drill stem and thus the direction of drilling. Encoded control signals may be sent from drilling equipment at the surface to the control electronics by encoding control data and transmitting it to the electronics package 44 by any suitable communications technique; for example by pulsing the drilling fluid or varying the speed of rotation of the drill stem. The control electronics in package 44 sense such variations in speed or receive signals corresponding to fluid pulses and decode the received control signals in the microprocessor. The control electronics then provide appropriate control signals for the actuator for operating the device. Power preferably is supplied to the control electronics and to the actuator by an alternator 46 (FIG. 2B) which is driven by the drill stem 10, as will be described in greater detail below.

Lateral shifting of the drill stem 10 with respect to housing wall 30 is carried out by an actuator 50 which, in the preferred embodiment of the invention, includes a multiplicity of pairs of eccentric cams located within the housing 24 and selectable to engage the wall 30. The actuator 50 is located approximately midway along the length of the housing 24, and the cams are selectively rotatable to shift the location of the central portion of the drill stem laterally away from the axis 52 of the housing in any desired direction and by a selectable amount. FIG. 2A illustrates the cams of actuator 50 positioned to shift the axis 54 of the drill stem 10 by a small distance. The upper and lower ends 56 and 58 of the drill stem are held by bearings 32, 34 and 36 so that the drill stem is coaxial with the housing at the upper and lower ends. A result of the shifting of axis 54 with respect to axis 52 by the actuator 50 is to cause the drill stem to bend within the housing. This causes the drill stem 10 to exit the housing at its lower end 58 at an angle with respect to axis 52 so that when the drill is operated, it will tend to advance in the direction of the bend, as diagrammatically illustrated in FIG. 2B by the converging axes 52 and 54.

Figure 3:
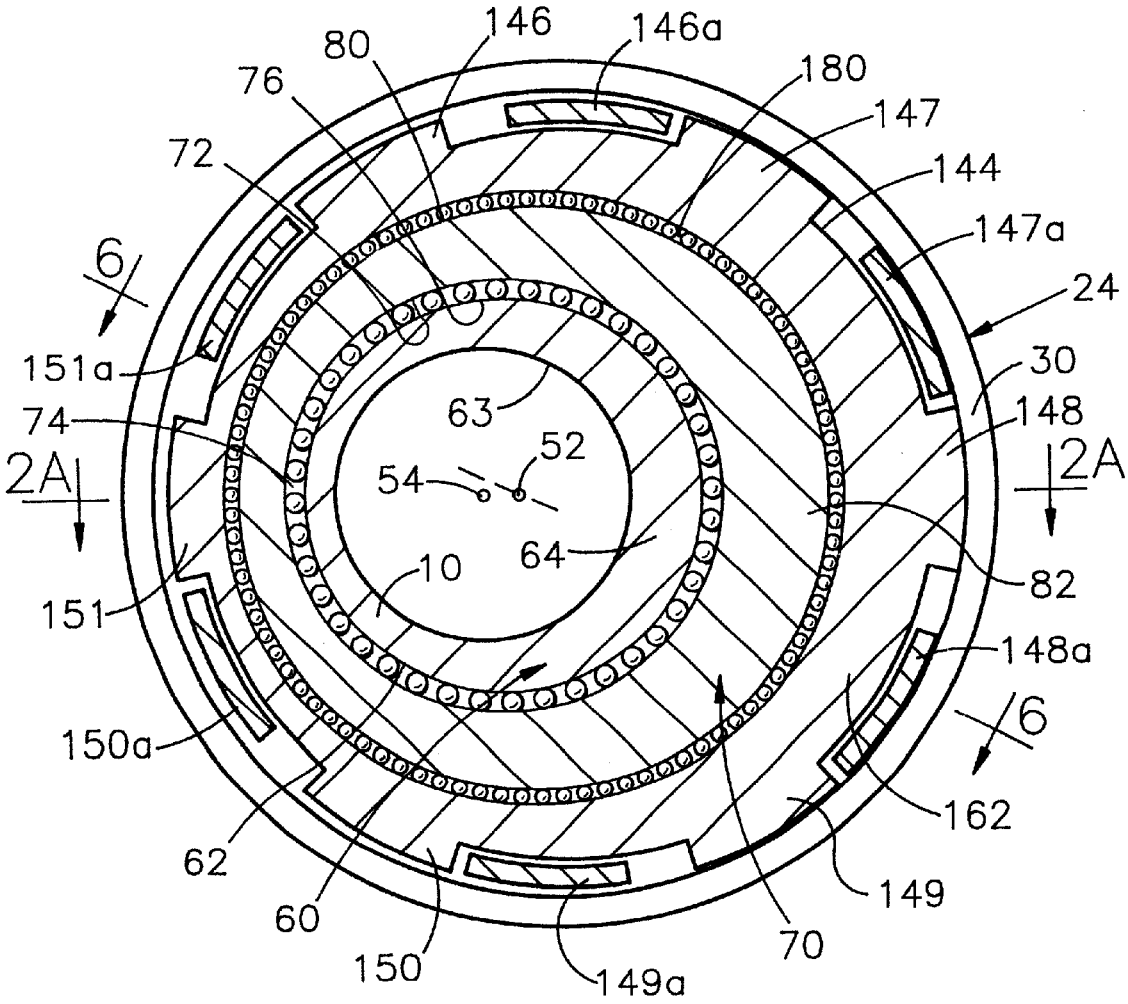
FIG. 3 is a cross-sectional view taken along line 3—3 of FIG. 2, illustrating the actuator as a plurality of concentric cams for shifting the position of the drill stem within the controller housing.

The actuator 50 is illustrated in a longitudinal cross-sectional view in FIG. 2A, the view being taken along lines 2A—2A of FIG. 3, and is illustrated in a transverse cross-sectional view in FIG. 3, this cross-section being taken along lines 3—3 of FIG. 2A. In addition, the actuator is illustrated in an exploded view in FIG. 4 and in a longitudinal cross-sectional view in FIG. 6, this view being taken along lines 6—6 of FIG. 3. In accordance with the invention, the actuator includes two sets of cams which include three pairs of coaxial, eccentric cams mounted on the drill stem 10, with the first pair of cams being integral with the drill stem, the second pair of cams being mounted on the first pair, and the third pair being mounted on the second pair and adapted to engage the wall 30 of housing 24. One cam of each pair constitutes a first set of coaxial cams, and the other cam of each pair constitutes a second set of cams, with the cam sets being side by side on the drill stem.

Figure 5:
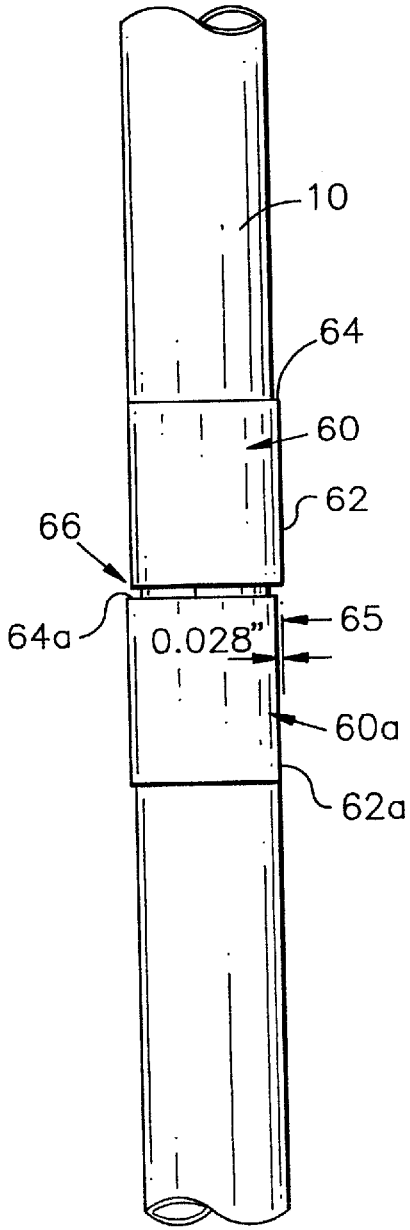
FIG. 5 is a side elevation view of a first cam pair formed on a drill stem.
Figure 8:
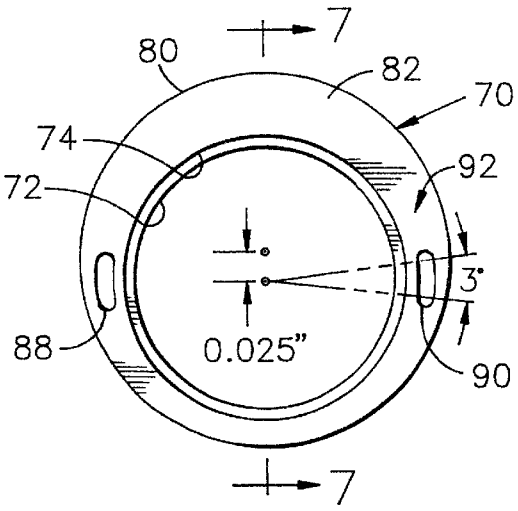
FIG. 8 is an end view of the cam of FIG. 7.
Figure 7:
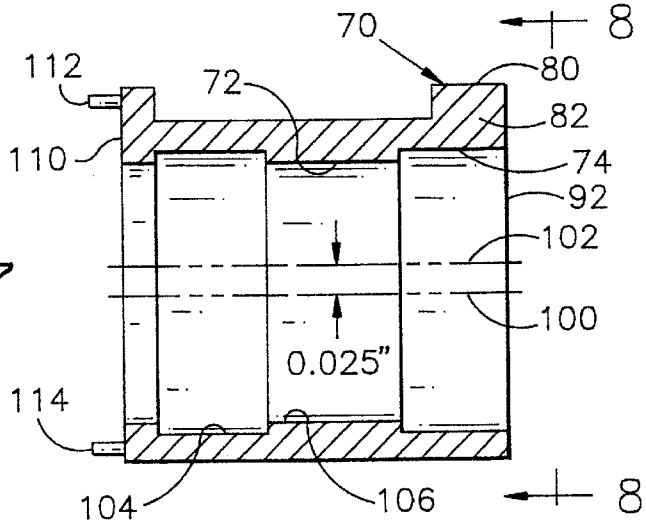
FIG. 7 is a cross-sectional view, taken along line 7—7 of FIG. 8, of a cam from a second cam pair of said actuator.

As illustrated in FIG. 2A and in FIG. 5, the drill stem 10 carries a first pair of cams 60 and 60*a* axially spaced along the drill stem and coaxial therewith, cam 60 being part of a first set of cams, and cam 60*a* being part of a second set of cams. The outer surfaces 62 and 62*a* of the two cams 60 and 60*a* are cylindrical, and thus are circular in cross-section, with the axis of the outer surface of each cam being offset from the axis 54 of drill stem 10 by about 0.014 inches. The inner surfaces of cams 60 and 60*a* are formed by the inner surface 63 of the drill stem 10, the offset axes providing eccentric cam surfaces. As illustrated, the axis of cam surface 62 is offset in one direction from axis 54 to form a lobe 64 extending radially to the right of axis 54 as viewed in FIGS. 3 and 5, while the axis of surface 62*a* is offset in the opposite direction, forming a lobe 64*a* extending radially to the left, as viewed in FIG. 5. The lobes 64 and 64*a* are diametrically opposed to each other; that is, the radius of maximum extension for lobe 64 is 180° out of phase with the radius of maximum extension of lobe 64*a* to produce a maximum radial offset 65 between the cam surfaces 62 and 62*a*. The cams are linked, as by being fixed on the drill stem, and rotate with the drill stem about its axis 54.

A circumferential groove 66 is formed on the surface of drill stem 10 between cams 60 and 60*a* of the first cam pair to receive a spring clip 68 (FIG. 2A) which extends upwardly from the drill stem surface and serves to axially separate the two cams of the second cam pair and to hold them in alignment with the first pair of cams 60, 60*a* on the shaft, as will be described.

The second pair of cams includes eccentric cams 70 and 70*a*, which form parts of the first and second sets of cams, respectively. Each of the cams has a corresponding cylindrical inner surface 72, 72*a* which carries a corresponding circular bearing race 74, 74*a*. The bearings carried in the bearing races in turn define cylindrical inner surfaces 76, 76*a*, which engage respective outer surfaces 62, 62*a* of corresponding cams 60 and 60*a* and allow the respective cams 70, 70*a* of the second cam pair to rotate freely about these outer surfaces 62, 62*a*. The outer surfaces 80, 80*a* of cams 70, 70*a* are cylindrical, with their axes each being offset from the axes of the inner surfaces 72, 72*a*, respectively, thereby forming eccentric cams having lobes 82, 82*a*, respectively. Each lobe has a radius of maximum extension which passes through the widest part of the lobe.

Figure 4:
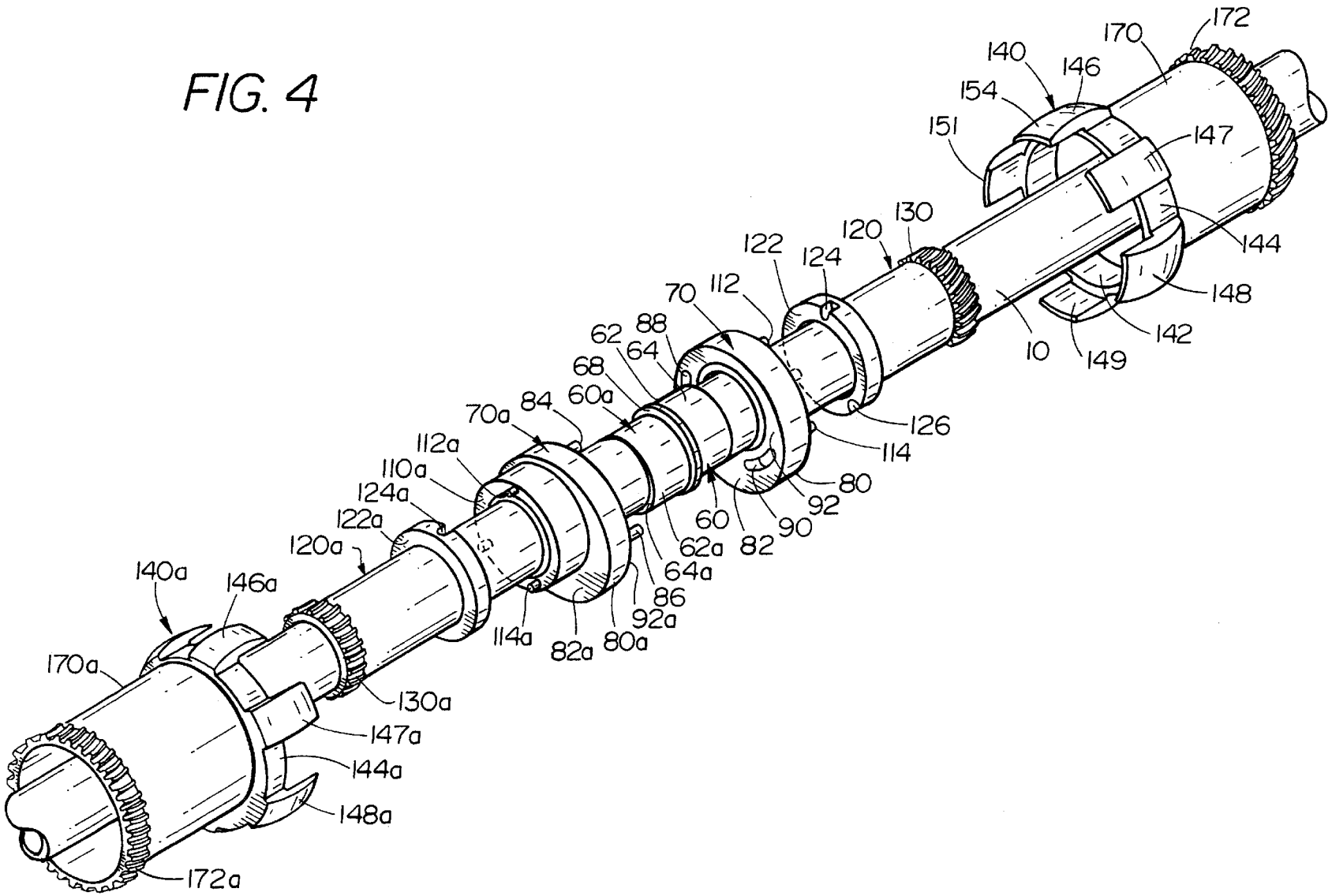
FIG. 4 is an exploded view of the actuator of FIG. 2, illustrating the multiple cam pairs of the invention.

Although each of cams 70 and 70*a* may freely rotate with respect to corresponding cams 60, 60*a*, the cams 70 and 70*a* are linked together so that relative rotation between them is restrained. The link may include one or more pins extending from one of the cams to engage corresponding grooves on the other cam, the grooves being sufficiently long to permit a relative angular rotation of about 3° between the two cams. Thus, as illustrated in FIG. 4, for example, cam 70*a* carries a pair of longitudinally extending pins 84 and 86 and cam 70 carries corresponding slots 88 and 90 on facing surfaces 92, 92*a* of the cams. When the outer cam pair 70, 70*a* is positioned on the corresponding inner cam pair 60, 60*a*, pin 84 engages slot 88 and pin 86 engages slot 90 to restrict the relative angular rotation between the two outer cams to about 3°, while both outer cams are free to rotate together with respect to their corresponding inner cams.

When the drill stem 10 is rotated within and with respect to the outer cams 70 and 70*a*, the rotating inner cams 60 and 60*a* move the outer cams radially inwardly and outwardly in opposition. That is, at any given location around the circumference of the drill stem, the rotation will cause the outermost surface of one set of cams (e.g. surface 80 of cam set 60, 70) to move radially outwardly while the outermost surface of the second set of cams (e.g. surface 80*a* of cam set 60*a*, 70*a*) to move radially inwardly. Thus, because the cams 60 and 60*a* are 180° out of phase, rotation of the drill stem causes the cam sets to move radially in opposite directions.

More particularly, the radius of maximum extension of lobe 82 is generally aligned with the radius of maximum extension of lobe 82*a*, so the lobes extend generally in the same radial direction, within the constraints of the pin and groove arrangement described above. In the preferred embodiment they extend radially in the same direction within plus or minus about 1.5°, but this can be varied. If the cam pair 70, 70*a* is held stationary while mounted on the first cam pair 60, 60*a*, rotation of the drill stem 10 will cause the opposed lobes 64, 64*a* of the first cam pair to shift the cams 70 and 70*a* radially in opposite directions, with the result that the lobes 82, 82*a*, for example, at the radius of maximum extension will move radially inwardly and outwardly toward and away from the axis of the drill stem 10, but 180° out of phase.

It will be understood that the pins 84, 86 fit loosely in the corresponding slots 88, 90 to accommodate the relative radial motion of cam 70 with respect to cam 70*a* caused by the rotation of cams 60 and 60*a*.

Cam 70 is illustrated in greater detail in FIGS. 5 to 8, where its inner peripheral surface 72 is shown as including a first bearing race 74 for receiving bearings 75, illustrated in FIG. 5, which engage the outer surface of cam 60 carried by the drill stem. Surface 72 is cylindrical and its axis 100 is coaxial with the axis of the cylindrical outer surface 62 of cam 60. As previously discussed, the outer cam surface 80 of cam 70 is also cylindrical, having an axis 102 which is offset from the axis 100 to provide the eccentric lobe 82.

Cam 70 includes a second bearing race 104 spaced axially from the bearing race 74 and separated therefrom by a cylindrical shoulder portion 106. The race 104 receives a second set of bearings 108 (FIG. 6) which also engages the outer surface 62 of cam 60, the spaced bearings 74 and 108 serving to keep the axis 100 of cam 70 generally parallel to the axis 54 of the drive stem. At the rearward end 110 of the cam 70 are mounted two or more drive pins 112, 114 which extend rearwardly from end 110 in a direction generally parallel to and equidistant from the axis 102 of the outer cam surface 80. Cam 70*a* is essentially a duplicate of cam 70.

As illustrated in FIGS. 2A and 4, cams 70 and 70*a* are driven by corresponding drive tubes 120 and 120*a* which are loosely mounted around the drive shaft 10 and are free to rotate with respect to it. Drive tube 120 includes at its forward end a radially extending flange or shoulder 122 which incorporates a pair of receptacles 124 and 126 (FIG. 4) which receive the drive pins 112 and 114, respectively. Rotation of the drive tube 120 exerts a rotational force on cam 70, causing this cam to rotate as far as is permitted by the pins 84, 86 and the slots 88, 90. Similarly, rotation of drive tube 120*a* causes rotation of cam 70*a* within the angular limits imposed by pins 84*a*, 86*a* and slots 88, 90, when the cams 70, 70*a* are assembled onto cams 60, 60*a* and are engaged by the respective drive tubes 120, 12*a*.

The rearward end of drive tube 120 carries a gear ring 130 which is engaged by a worm gear 132 (FIG. 2A) which may be driven either mechanically or by an electric motor, as will be described. Selective operation of the drive gear 132 rotates the drive tube 120 in either direction, in order to rotate cam 70. In similar manner, ring gear 130*a* is driven by a corresponding worm gear 132*a* in either direction to rotate cam 70*a* through drive tube 120*a*. The drive tubes 120, 120*a* may be of any convenient length, and have an inner diameter greater than the outer diameter of the drill stem by an amount that is sufficient to accommodate curvature in the drill stem caused by operation of actuator 50. The tubular drive tubes preferably are held in engagement with their respective cams by means of spring clips (not shown) engaging the outer surface of the drill stem 10, these spring clips also serving to hold the cams 70, 70*a* in place on their respective cams 60 and 60*a*.

Figure 11:
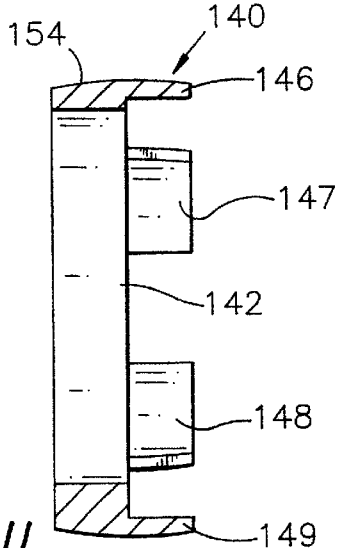
FIG. 11 is a cross-sectional view of the cam of FIG. 9, taken along line 11—11.
Figure 10:
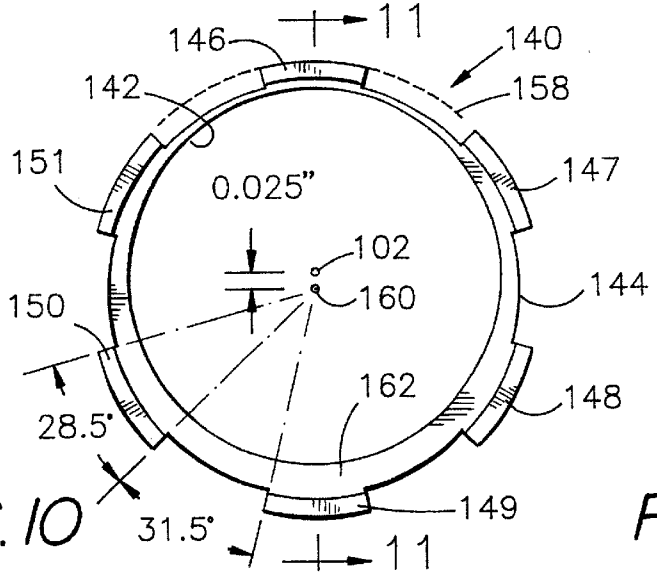
FIG. 10 is a side elevation of the cam of FIG. 9.

A third pair of cams, generally indicated at 140 and 140*a* are included in the first and second sets of cams, respectively, and are rotatably mounted on cams 70 an 70*a*, respectively, as illustrated in FIGS. 2A, 3, 4 and 6. As illustrated in these figures and also in FIGS. 9 through 11, cam 140 incorporates an inner cylindrical surface 142 which receives cam 70 and is coaxial with axis 102 of cam surface 80. The cam 140 includes a peripheral surface 144 which is also generally cylindrical, but which includes a plurality of outwardly and forwardly extending fingers 146 through 151. Each finger includes a curved outer surface such as the surface 154 indicated on finger 146, with surface 154 being curved both circumferentially and longitudinally so as to engage the inner surface 156 of housing wall 30 (see FIG. 2A) along a circumferential line. The longitudinal curvature of surface 154 allows the cam 140 to tilt forwardly or backwardly from a plane perpendicular to the axis 52 of housing 24 to thereby accommodate bending of shaft 10 with respect to housing 24. The circumferential curvature of the surfaces of the finger defines a circle 158 (FIG. 9) which is coaxial with surface 144 and has a diameter slightly smaller than the inner diameter of housing 24, so that the actuator can be rotated within the housing.

The axis 160 of cylindrical surface 144 and of circle 158 is offset from the axis 102 of surface 142 so that cam 140 includes an eccentric lobe 162 having a radius of maximum extension.

Cam 140*a* is substantially identical to cam 140 and is mounted on the outer surface 80*a* of cam 70*a*. When cams 140 and 140*a* are mounted on their respective cams 70 and

Figure 6:
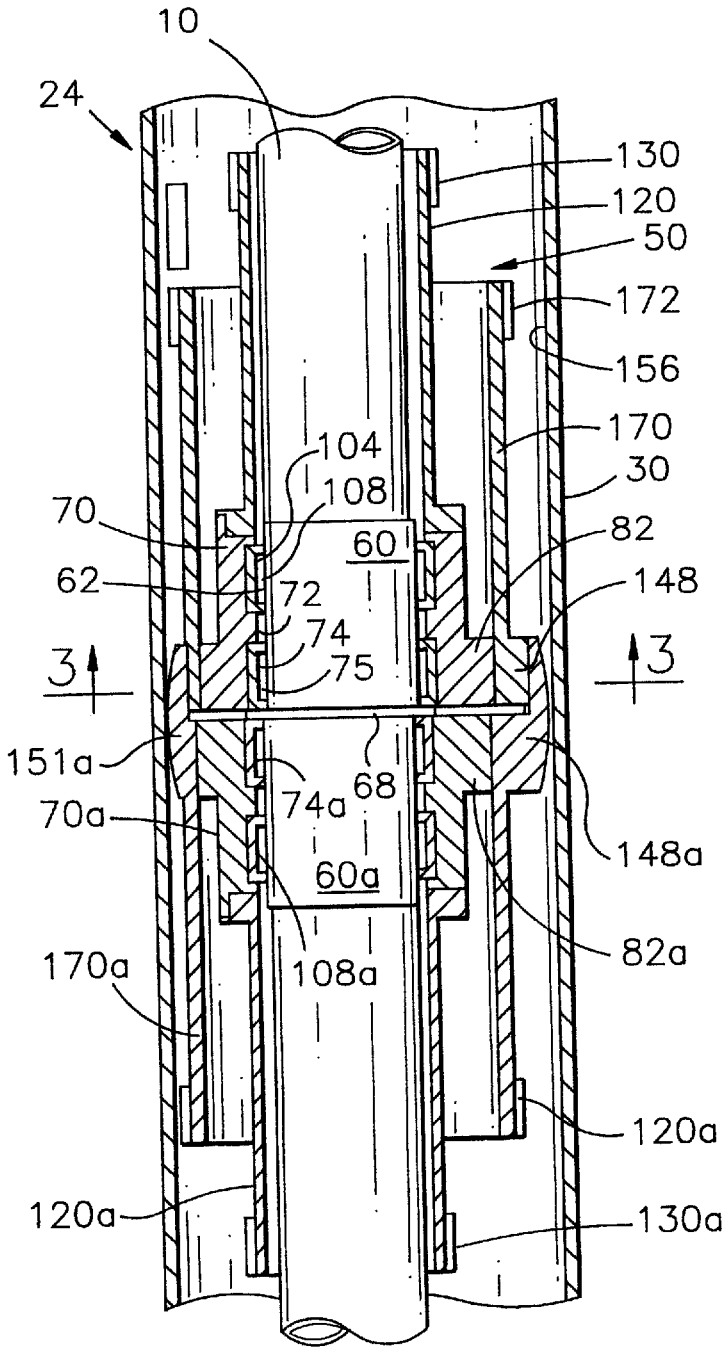
FIG. 6 is a cross-sectional view, taken along line 6—6 of FIG. 2, of the actuator of the invention.
Figure 9:
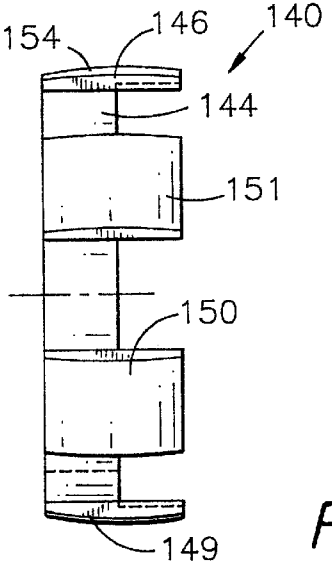
FIG. 9 is an end view of a cam from a third cam pair of said actuator.

70*a,* the fingers 146 through 151 are interdigitated, or linked, with the corresponding fingers 146*a* through 151*a,* as illustrated in FIGS. 2A and 6, so that the radii of maximum extension for the lobes 162, 162*a* are in approximately the same direction. In a preferred embodiment of the invention, as illustrated in FIG. 9, the angular width of each of the fingers is approximately 28.50°, while the angular spacing between adjacent fingers is approximately 31.50°, so that when the two cams are interdigitated, the fingers permit relative angular motion between the two cams of about 3°. When the cams are assembled in this manner, the radii of maximum extension are about 3° apart, and the fingers of cam 140 extend over the surface 80*a* of cam 70*a* while the fingers of cam 140*a* extend over the surface 80 of cam 70. The inner surfaces of the fingers are spaced slightly outwardly from the surface 144 to ensure freedom of motion of the two cams. Because outermost cams 140 and 140*a* are mounted on the intermediate cams 70 and 70*a,* respectively, the outermost cams will be shifted radially inwardly and outwardly by the rotation of drill stem 10, as described above for cams 70 and 70*a*. Accordingly, the cam set which includes cams 60, 70 and 140 and the cam set which includes cams 60*a,* 70*a* and 140*a* are alternately moved radially inwardly and outwardly.

Cams 140 and 140*a* are rotated by corresponding drive tubes 170 and 170*a* which may be fastened to the rear surfaces of the respective cams, as illustrated, or which may be connected to the respective cams by suitable pins and slots in the manner described with respect to cam 70 and its drive tube 120. The rearward ends of tubes 170, 170*a* carry corresponding ring gears 172 and 172*a* which are engaged by corresponding worm gears 174 and 174*a* (FIG. 2A). These may be mechanically or electrically driven, as described above for worm gears 132 and 132*a*. If desired, a bearing ring 180, such as that illustrated in FIG. 3, can be mounted on the inner surfaces 142, 142*a* of cams 140, 140*a* to provide a bearing surface between these cams and the corresponding outer surfaces 80, 80*a* of cams 70, 70*a*.

With the three pairs of cams assembled in sets as illustrated in FIG. 2A, rotation of drive shaft 10 will rotate the two cams 60 and 60*a* to cause radial motion of the second and third pairs of cams 70, 70*a* and 140, 140*a* toward and away from the wall of housing 24. Since the maximum extension of cams 60 and 60*a* are 180° out of phase, the radial motion of the corresponding outer cams in each set will also be 180° out of phase so that when lobe 82 of a first set of cams is shifted to the right by cam 60, as illustrated in FIG. 2A, corresponding lobe 82*a* of a second set will be shifted to the left by cam 60*a*. This will also cause lobe 162 and finger 148 of cam 140 in the first set to shift to the right into engagement with the interior surface 156 of housing 24 and will cause lobe 162*a* and finger 148*a* of the second set of cams to shift to the left, out of engagement with the surface 156 to release the second set.

When the sets of cams are alternately released, the intermediate cams of the released set can be rotated in small steps by their corresponding drive tubes to adjust the angular relationship between the intermediate and outer lobes of the sets. Similarly, the outer cams of the released set can be rotated in small steps (3°) by corresponding drive tubes to shift the points of contact between the outer cams and the inner surface 156 of the housing around the circumference of the housing. The outer cam which is in contact with the housing forces the axis of shaft 10 to shift to the left (as viewed in FIG. 2A), away from axis 52 of housing 24, thereby bending the drive stem 10 in a direction controlled by the rotational position of the cam set engaging the housing.

When the two sets of cams are assembled, the intermediate cams 70 and 70*a* are linked by means of pins 84, 86 and slots 88 and 90, with their lobes 82 and 82*a* in close angular alignment and with the maximum extensions of the lobes being within plus or minus 1.5° of each other. As previously explained, the lobes 64 and 64*a* of inner cams 60 and 60*a* are 180° out of phase, so that when the cams 70 and 70*a* have been assembled onto the drill stem, the cam surfaces at lobes 82 and 82*a* will be offset radially from each other by a distance equal to the radial offset of cam surfaces 62 and 62*a*. Similarly, outer cams 140 and 140*a* are assembled so that the maximum extent of lobes 162, 162*a* are in general alignment with each other, with the interlocking of the fingers ensuring that they will have an angular offset, for example, of plus or minus 1.5°. Since the cams 140, 140*a* are rotatable about cams 70, 70*a,* respectively, the angular direction of lobes 162, 162*a* with respect to the angular direction of lobes 82, 82*a* is arbitrary and is selected by the control circuitry to be described. The angular relationship between these lobes determines the amount of bend in the drill stem. In the embodiment illustrated in FIGS. 2A and 3, the maximum extent of each of the lobes 64, 82 and 162 are aligned toward the right, as viewed in both figures, to provide maximum spacing between the axis 54 of the drill stem and axis 52 of the housing, thus producing maximum bending of the drill stem.

If drill stem 10 is rotated 180°, then cam 60*a* will be reversed from the position shown in FIG. 2A and will cause lobes 82*a* and 162*a* as well as finger 148*a* of the second set of cams to shift to the right into engagement with the inner surface 156 of housing 24. At the same time lobe 60 will shift toward the left and will shift lobes 82 and 162 of the first set of cams toward the left to disengage finger 148 from surface 156. Continuous rotation of drill stem 10 thus will cause first one and then the other of the cam fingers 148, 148*a* to engage the interior of housing 24 to maintain the drill stem in its shifted position.

If it is desired to change the direction or the amount of bend in drill stem 10, the angular locations of the lobes 82, 82*a* and 162, 162*a* may be changed by rotating the respective cams when they are disengaged from the sidewall of the housing. Thus, for example, when cam 60 is in the position illustrated in FIG. 2A it exerts pressure through cam lobe 82 and cam lobe 162 and finger 148 to housing 24 to hold the drill stem in its offset position. However, since cam 60*a* is 180° out of phase, it has shifted the corresponding finger 148*a* away from the surface of the housing. Therefore, cam 70*a* and cam 140*a* do not exert any pressure on the housing, and can easily be rotated by their corresponding drive tubes 120*a* or 170*a*. The rotational (angular) motion of each cam about its axis is limited to about 3° by the pin and groove arrangement or by the interdigitated finger arrangement of the respective cams, so the released cams can each be advanced in a step of about 3°. When the drill stem has rotated 180°, finger 148 is released from its contact with the interior surface 156 and finger 148*a* is moved radially outwardly to engage the housing and hold the drill stem in its deflected position. At this time, cams 70 and 140 can be driven through an angle of about 3° each by their respective drive tubes 120 and 170 under the control of worm drives 132 and 174 to advance each of these cams by a step of about 3°. The lobes 82, 82*a* and 162, 162*a* can be stepped ahead a maximum of 3° for each complete rotation of the drill stem 10, and the location of the lobes 82, 82*a* and 162, 162*a* can thereby be rotated completely around the axis of the housing in 36 steps to change the angular location of the contact point between the cam fingers and the interior surface of housing 24 and to change the distance between the axis of the drill stem and the axis of the housing. The angular location of the contact point and the relative angular locations of the lobes of the cam pairs determine the direction and the amount of shifting of axis 54 with respect to axis 52, thereby controlling the degree of bend and the direction of bend of drill stem 10.

Figure 12:
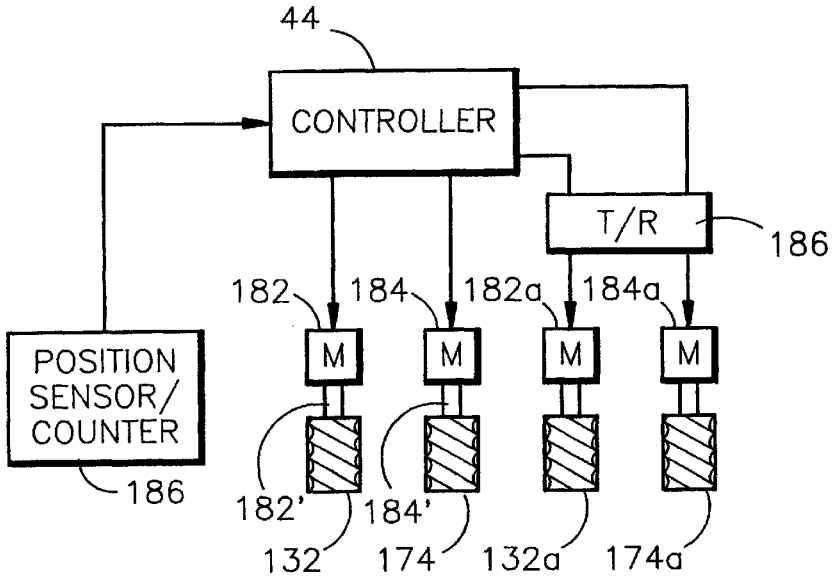
FIG. 12 is a diagrammatic illustration of an electrical control system for the actuator of the present invention.

The worm gears 132 and 174, which drive the tubes 120 and 170, respectively, may be driven by small electric motors 182 and 184, respectively, as illustrated diagrammatically in FIG. 12. These motors may be switched on and off by controller 44 to operate the respective gear drives through corresponding drive shafts 182' and 184'. The motors 182 and 184 preferably are mounted on the interior of wall 30 of housing 24 and are selectively activated to rotate the corresponding drive tubes as required to adjust the location of the drill stem in the manner discussed hereinabove. A position sensor or counter 186 may be provided in the housing for counting the teeth on ring gears 130 and 172 as the respective drive tubes 120 and 170 are rotated, the count being supplied, for example, to a microprocessor in the controller 44 which then determines the direction of the lobes 82 and 162 driven by the tubes so that the direction and amount of bend in the drill stem can be determined.

In similar manner, worm gears 132*a* and 174*a* are driven by electric motors 182*a* and 184*a,* respectively. These motors may be directly connected to the controller 44, or may be connected through a suitable transmitter receiver (TR) linkage indicated at 186. Such a linkage may impose control data currents on the drill stem 10 at the controller and receive those signals at a remote location by way of a sensing solenoid surrounding the drill stem near and connected to the control motors.

Figure 13:
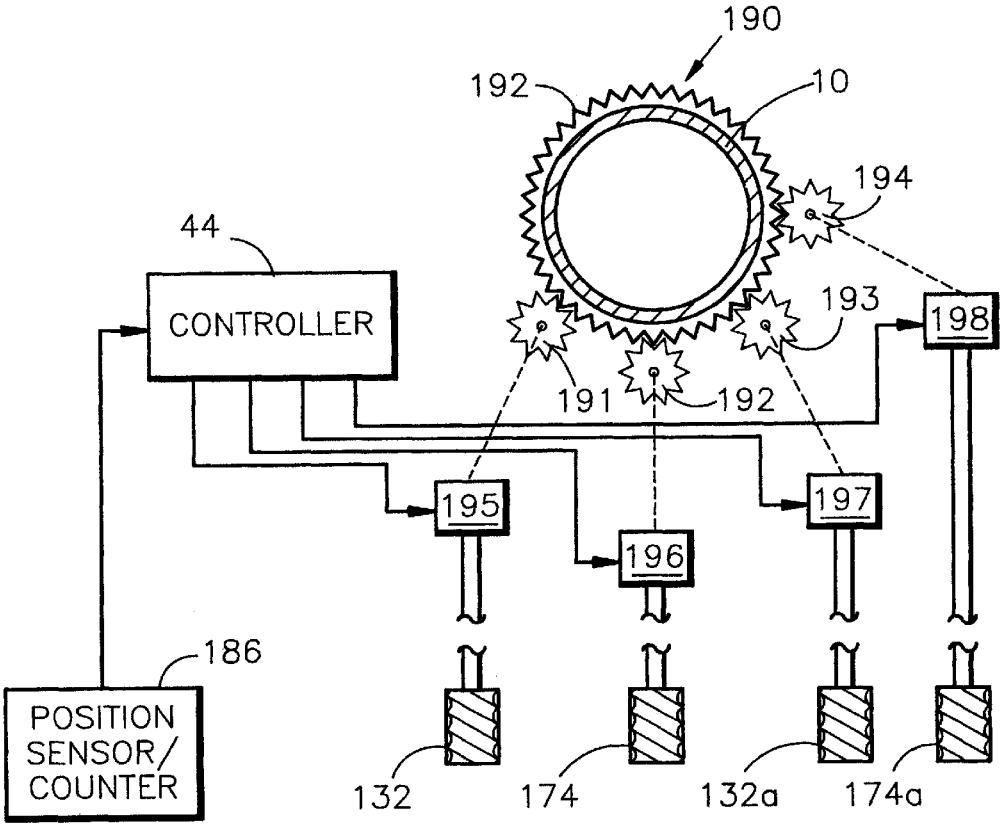
FIG. 13 is a diagrammatic illustration of a power takeoff and control system for the actuator.

Alternatively, the worm gears 132, 132*a* and 174, 174*a* may be driven mechanically from one or more power takeoff assemblies such as the power takeoff 190 illustrated diagrammatically in FIG. 13. The power take off may be, for example, a ring gear 192 mounted on and rotatable with the drill stem 10, with multiple takeoff gears 191, 192, 193 and 194 engaging ring gear 192. These gears may be connected through flexible drive shafts and corresponding clutches 195, 196, 197 and 198, and through corresponding drive shafts to corresponding worm gears 132, 174, 132*a,* and 174*a*. These clutches are selectively activated by controller 44 to allow the power takeoff to drive selected worm gears and to thereby rotate the corresponding drive tubes 120, 170, 120*a* and 170*a*. Again, the position sensor, or counter 186 may be connected to the controller 44 to provide a feedback measurement of the position of each of the several drive tubes.

Figure 14:
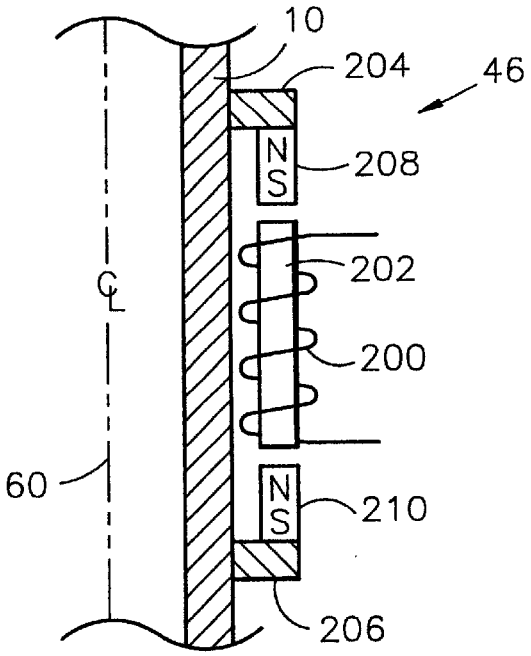
FIG. 14 is a diagrammatic partial view of an alternator for the directional controller of FIG. 2A and 2B.
Figure 15:
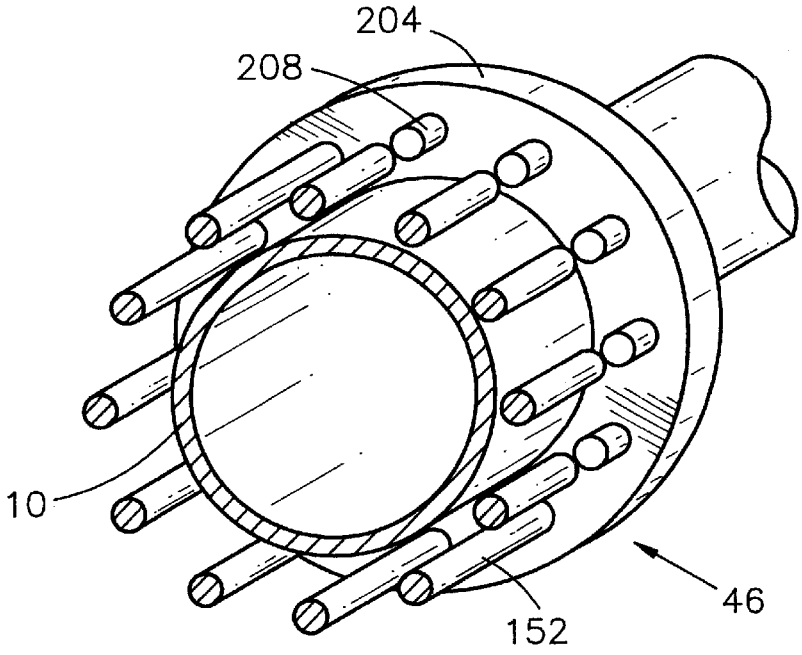
FIG. 15 is a diagrammatic partial perspective view of the alternator of FIG. 14.

Electrical power for driving the control circuitry and for energizing the coils is obtained from alternator 46, which is illustrated in FIGS. 2B, 14 and 15, to which reference is now made. The alternator 46 preferably consists of a plurality of fixed coils 200 mounted on corresponding fixed cores 202 spaced around the drill stem 10, as illustrated in FIG. 15. The cores 202 are mounted on housing wall 30. At each end of the cores 202 are ferromagnetic rings 204 and 206 carrying spaced permanent magnets 208 and 210, respectively. Ring 204 and its corresponding permanent magnets 208, and portions of cores 202, are illustrated in FIG. 15, ring 206 and cylindrical wall 30 being cut away for clarity. The magnetic rings 204 and 206 are fixed to, and rotate with, the drill stem 10 to sequentially energize the coils 200 on the respective cores 202. The alternating axial field produced in the adjacent cores produces sufficient output current in coils 200 to drive the controller 44 and other electrical components located downhole in the housing 24. The longitudinal alignment of the cores 202 parallel to the axis 54 of the drill stem 10 reduces the diameter of the alternator, and location of the alternator near bearings 36, or near bearings 32, 34 above the housing 24, reduces the effect of drill stem bending on the alternator output.

Figure 16:
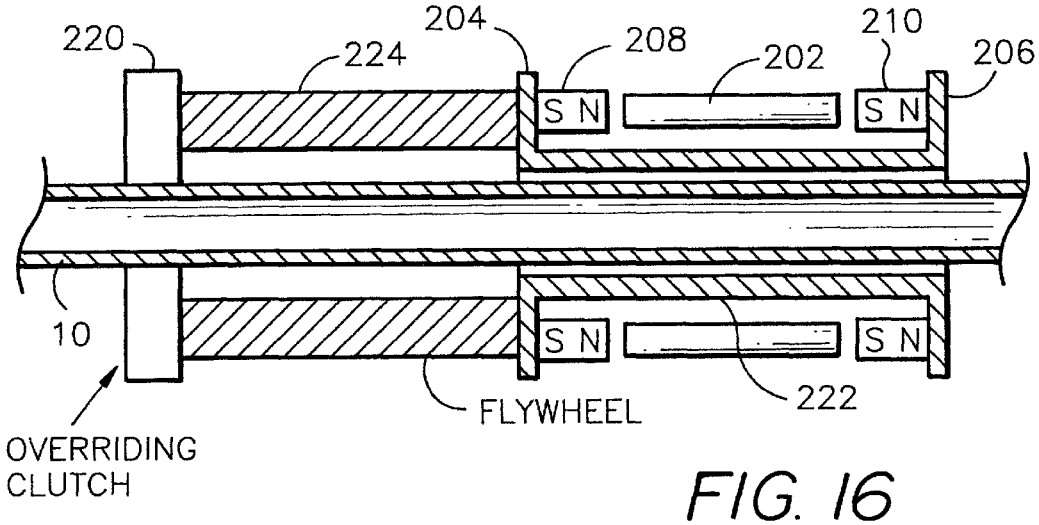
FIG. 16 is a diagrammatic cross-sectional view of the alternator of FIGS. 14 and 15, driven by a flywheel.

If desired, the ferromagnetic rings 204 and 206 may be mounted for rotation with respect to the drill stem 10, and connected to stem 10 through an overriding clutch arrangement, of well-known configuration and illustrated diagrammatically at 220 in FIG. 16. This allows the rings to continue rotating if the drill stem is stopped, as by the drill head sticking, thereby insuring continuity of the output current. When the drill stem resumes rotation, the one-way clutch 220 catches the rings and continues operation of the alternator in the normal way. The ferromagnetic plates 204 and 206 can be constructed to be rotatable with respect to the drill stem 10 by mounting them on a tube 222 surrounding the drill stem. If desired, the tube 222 may be secured to a fly wheel 224 surrounding the drill stem and having sufficient mass to operate the alternator after the drill stem stops, for example for about 30 seconds, as illustrated in FIG. 16. In this case, the fly wheel would be connected to the drill stem through the overriding clutch 220, also as illustrated in FIG. 16.

Figure 17:
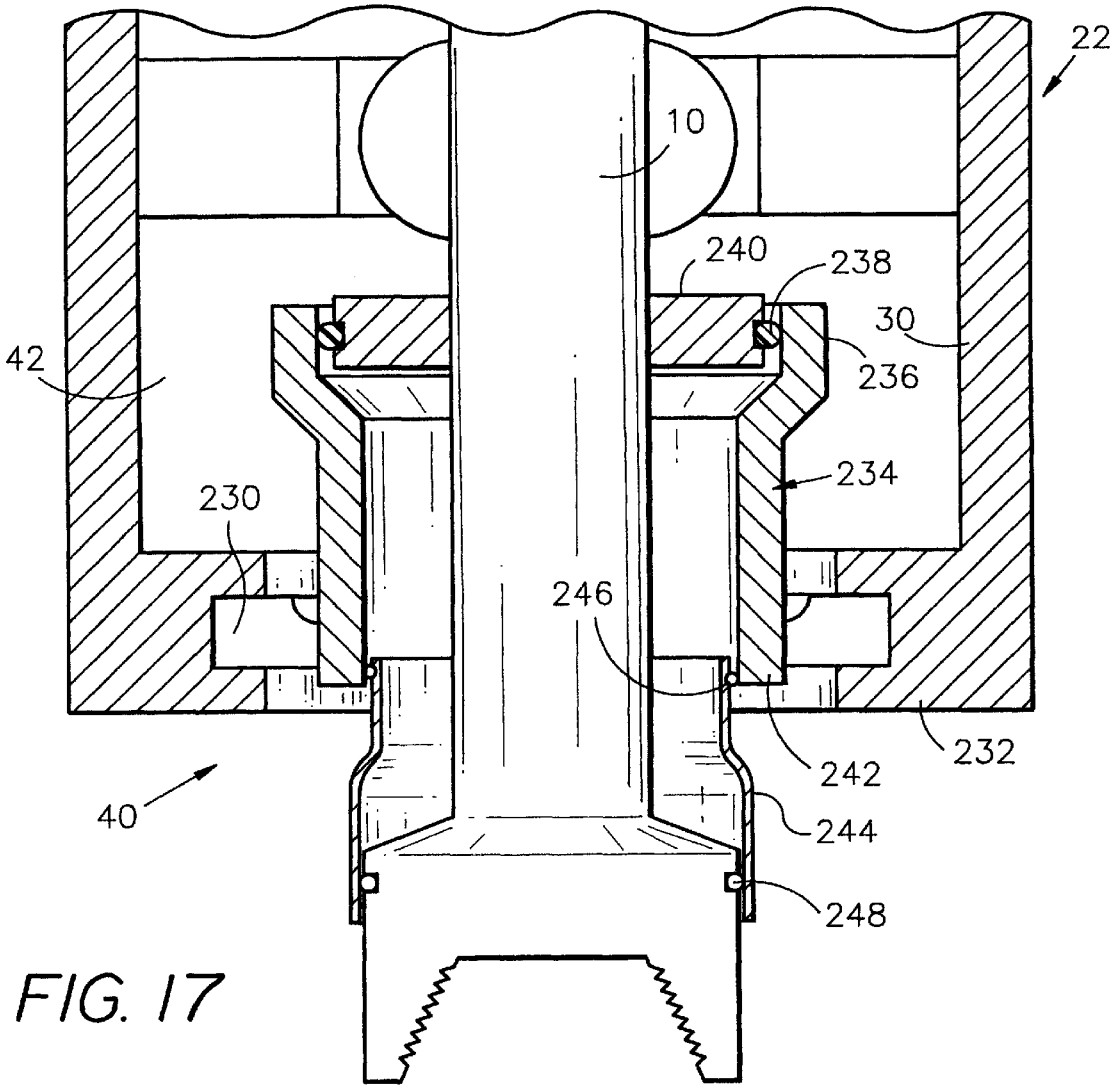
FIG. 17 is an enlarged, cross-sectional view of an oil seal for the directional controller housing of FIG. 2.

A preferred form of the oil seal 40 for the present invention is illustrated in greater detail in FIG. 17, to which reference is now made. The seal 40 includes a conventional Kalsi seal 230 mounted in the bottom wall 232 of housing 24. In accordance with the present invention, the Kalsi seal engages a floating sleeve 234 which surrounds drill stem 10. Sleeve 234 has an outwardly-flared upper end 236 which engages an O-ring seal 238 mounted on the drill stem by means of a fixed sealing ring 240, and has a lower end 242 which engages the Kalsi seal 230. The sleeve 234 is capable of pivoting about the O-ring seal 238 so that when the drill stem 10 is curved by operation of the eccentric cams of actuator 50, the sleeve 234 "floats", and radial forces are not transferred to the Kalsi seal 230. Thus, the sleeve 234 acts as a floating drill stem, allowing the seal 230 to maintain contact with it during operation of the drill stem. The sleeve 234 is polished and heat treated so it can maintain a good contact with the O-ring 238 and the Kalsi seals, and is a replaceable part, its dimensions being such that it will slide out of housing 24 and over the end of drill stem 10.

If desired, a shield 244 may be provided at the lower end of sleeve 234 to prevent debris from accumulating within the sleeve. This shield may incorporate an O-ring 246 at its upper end in engagement with the interior surface of sleeve 234, and an O-ring 248 at its lower end in engagement with the outer surface of drill stem 10.

Figure 18:
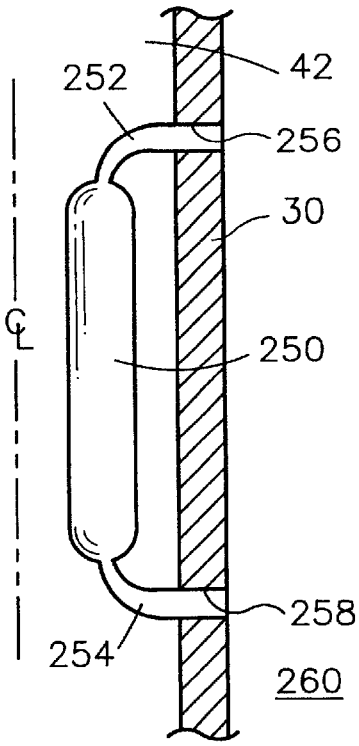
FIG. 18 is a diagrammatic view of a pressure equalizer for the directional controller housing.

If it is desired to equalize the pressure within the housing 24 to the ambient pressure outside the housing, a flexible bladder 250 may be is located within the housing, as illustrated in FIG. 18. The interior of the bladder is connected by way of a pair of bleed tubes 250 and 254, which extend through apertures 256 and 258, respectively, to the annulus 260 (FIG. 1) between the housing 24 and the borehole 14. This allows the bladder to contract and expand as the difference in temperature and pressure between the housing and the borehole vary.

Figure 19:
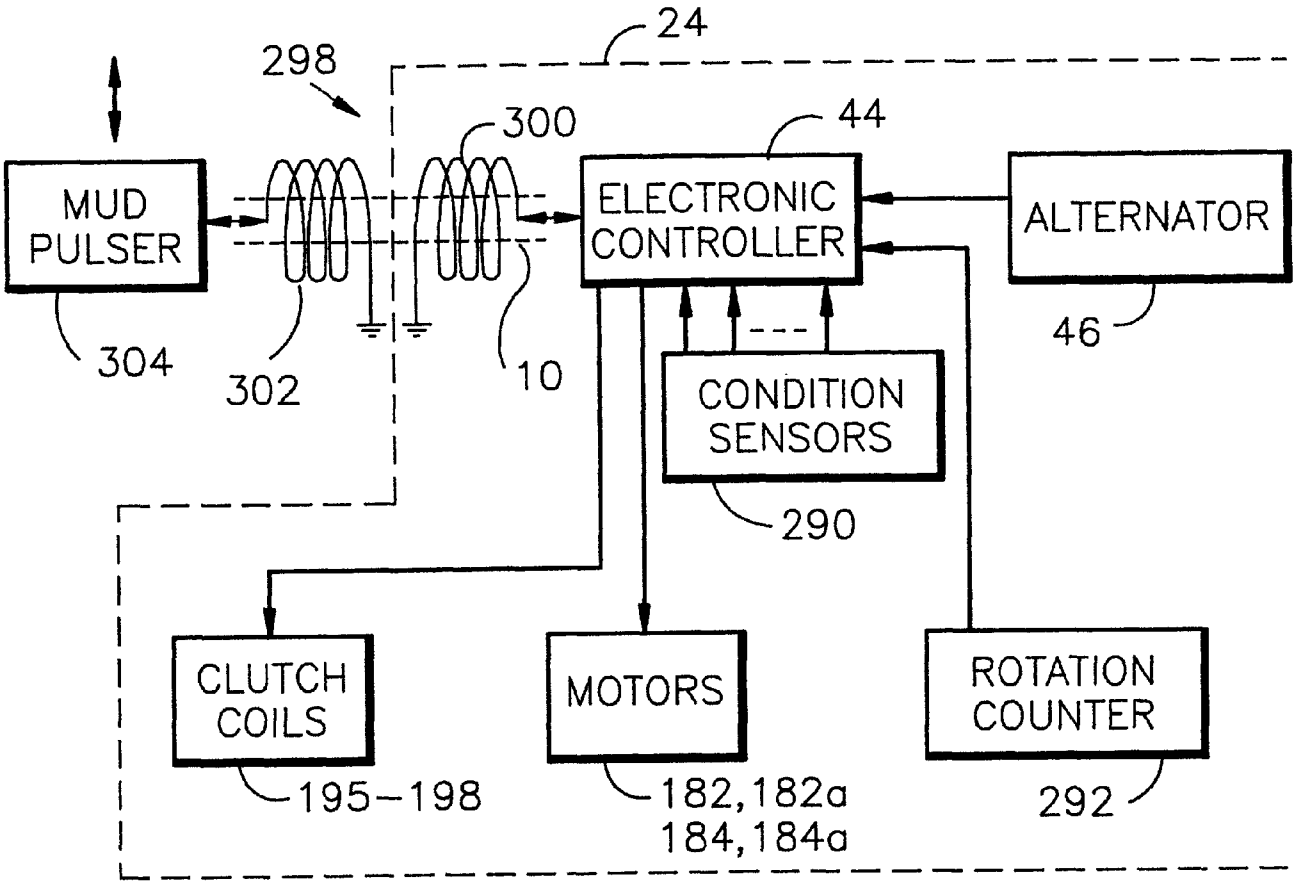
FIG. 19 is a block diagram of downhole controller circuitry for the directional controller of the present invention.

Down hole controller circuitry for the above-described embodiments is illustrated in FIG. 19, to which reference is now made. The electronic controller 44, which preferably includes a microprocessor, in addition to being connected to sensor 186 described above, may be connected to multiple sensors 290 which respond to ambient conditions in the borehole, such as temperature and and pressure, and which can also sense rotation of the actuator, orientation of housing 24, and the like. Rotation of the drill stem may be measured by a counter 292 adjacent a permanent magnet 294 on the drill stem (FIG. 2A). Similar magnetic counters may be provided on the drive tubes, as well, to enable the controller 44 to determine the relative direction of curvature of the drill stem with respect to the housing. The orientation of the housing may be measured by magnetic field sensors and/or accelerometers in sensor 290 to permit an accurate determination of the direction in which the drill will move due to its curvature. The alternator 46 supplies electrical power to the controller 44 and through the controller selectively to the motors 182, 182*a* and 184, 184*a,* or to the clutches 195–198.

The controller 44 may be used to encode detected information signals or data for transfer to the earth's surface by way of a suitable communications link 298. In a preferred form of the invention, this link may include a first induction coil 300 on drill stem 10 within the directional controller housing 24, the coil being connected to controller 44 to receive the encoded signals to be transmitted hole. The encoded signals in the coil have sufficient amplitude to produce corresponding signals of about 100 milliamps at about 1 kHz in the steel drill stem 10.

The signal currents produced by coil 300 are detected by a pickup coil 302 on the drill stem 10 outside the housing 24. The coil 302 may be located up to about 10 meters above the housing 24, and is connected to a conventional mud pulser 304 located in the drill stem 10. The pulser receives the data signals from coil 302 and transmits the data up hole by pulsing the drilling fluid in the drill stem, and such pulses are detected in known manner at the earth's surface.

Control signals may be sent down hole from the surface to the electronic controller 44 by the same data link, the control signals being received at pulser 304 from the surface and converted to electrical signals on drill stem 10 by coil 302. The coil 300 detects these electrical signals and transfers them to controller 44 for decoding and subsequent use to regulate and/or operate the directional controller, for example by establishing or modifying a program for selectively energizing the motors or clutches for the worm gears to control the direction of drilling. Accordingly, the communications link including coils 300 and 302 permits feedback control of the actuator mechanism in the directional controller 22. The transmit/receive link 186 discussed above may be similar to the data link 298.

Figure 20:
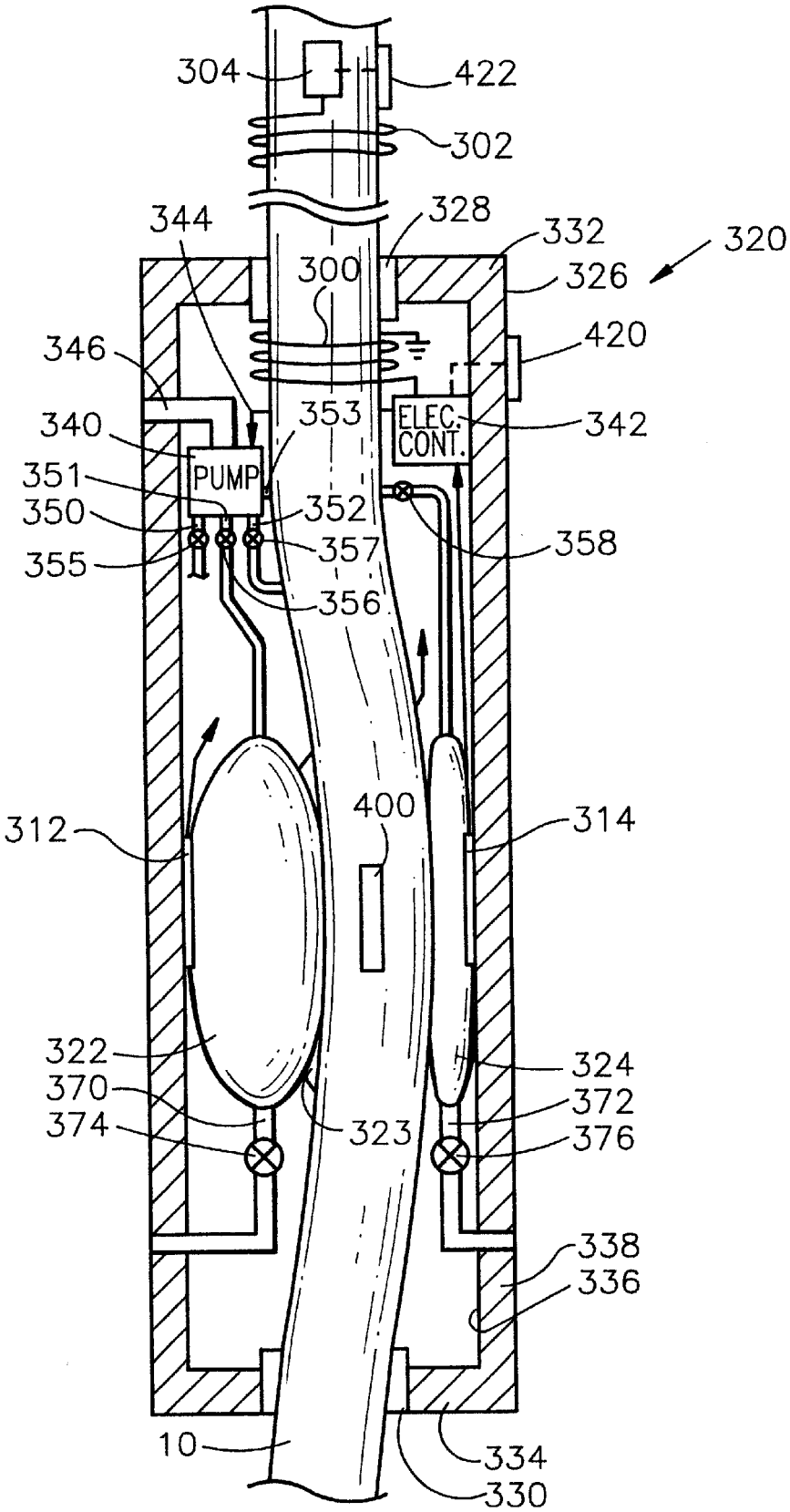
FIG. 20 is a diagrammatic illustration of a directional controller utilizing a plurality of fluid-filled containers.
Figure 21:
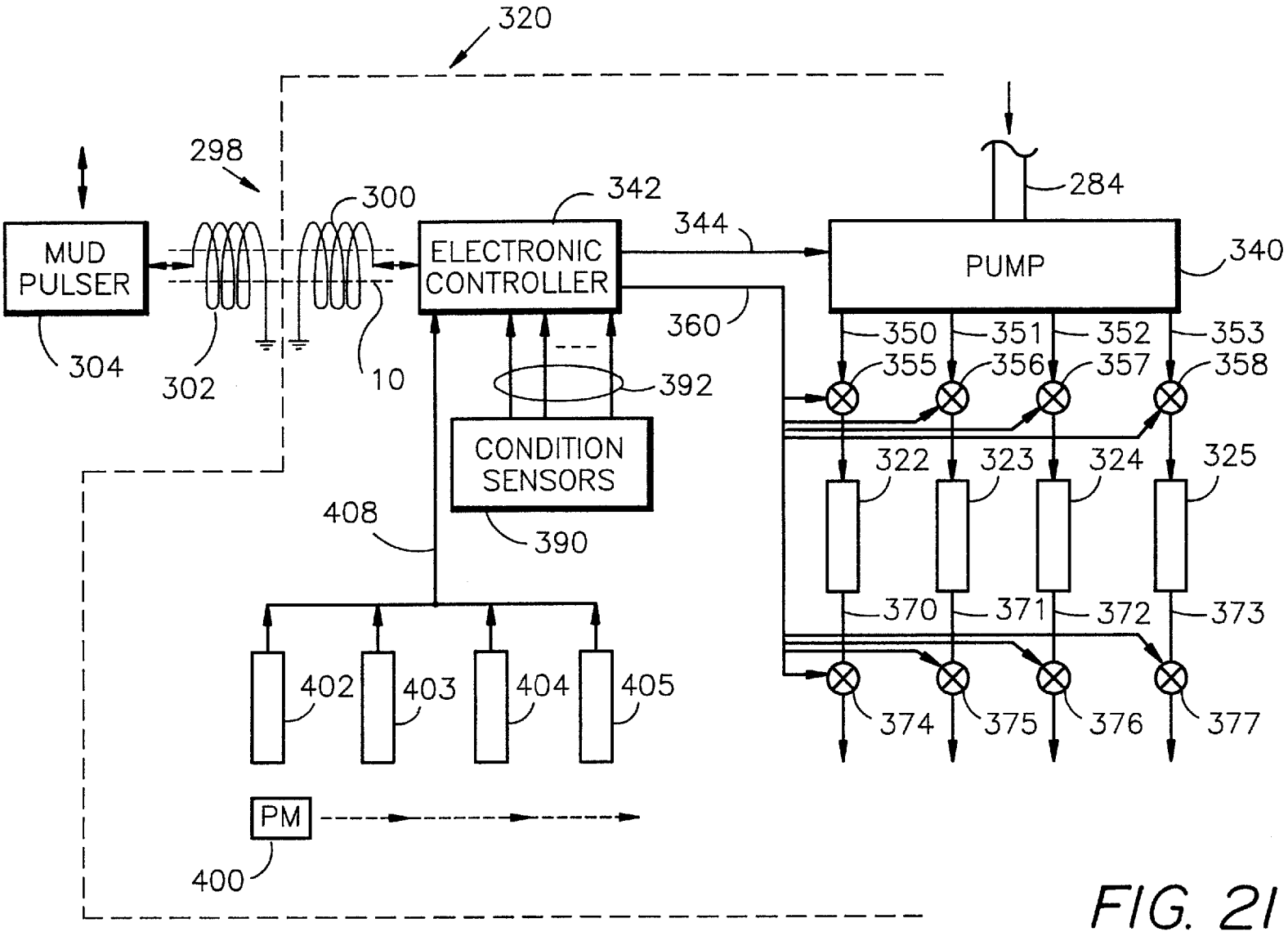
FIG. 21 is a block diagram of a controller for the fluid-filled containers of FIG. 22.

In another embodiment of the invention, a directional controller 320 includes a plurality of fluid-filled containers, such as those illustrated at 322–325 in FIGS. 20 and 21. (Container 325 is not shown in FIG. 20) In this embodiment, the directional controller includes a housing 326 surrounding the drill stem 10, and mounted on the drill stem by suitable bearings and oil seals 328 and 330 at opposite ends of the housing between the housing end walls 332 and 334, respectively, and the drill stem. Preferably, four containers are provided, spaced 90° apart around the circumference of drill stem 10. The inner surface of each of the bags engages the drill stem, while the outer surface of each bag engages the interior surface 336 of the cylindrical side wall 338 of the housing.

The bags are selectively inflated, as by an electrically driven hydraulic pump 340 operated selectively by control circuitry 342 by way of control lead 344. The pump has an inlet 346 which leads to the exterior of housing 326 to pick up drilling fluid from the borehole being drilled. The pump includes four outlets 350–353 which lead through solenoid-controlled valves 355–358, respectively, to respective inflatable containers 322–325. The valves are connected to controller 342 through corresponding control cable 360 (FIG. 21) and are operable to selectively inflate the containers. Outlets 370–373 of the containers lead through respective solenoid-controlled outlet valves 374–377 to the exterior of housing 320. The outlet valves are controlled by controller 342 through control cable 360 and are operable to selectively deflate the containers. The operation of the inlet and outlet valves by controller 342 permits controlled inflation and deflation of selected fluid containers which, in turn, deflect the axis of drill stem 10 with respect to the axis of housing 320. The housing 320 is stationary within the borehole being drilled, as described above, and this allows the stem to be bent in any desired direction to control the direction of drilling.

The amount of bend in drill stem 10 can be conveniently measured, in the embodiment of FIG. 20, by measuring the fluid pressure in each of the containers, for example by means of a pressure sensor in each of the containers or in each of the fluid lines leading to or from the containers, as generally indicated at 390 in FIG. 21. Sensor output signals representing the measured pressure can be supplied to the electronic controller 342 by way of lines 392 to measure the drill stem deflection. These signals serve to enable the controller to provide a feedback control of that deflection.

Another feedback control arrangement is illustrated in FIGS. 20 and 21, but can be used in any of the above-described embodiments. In this arrangement, the deflection of the drill stem is measured magnetically, as by embedding a permanent magnet 400 in the surface of drill stem 10 near the actuator 50, preferably as close as possible to the location of the maximum bend produced by the actuator. Four magnetic field sensors, or pickup coils, 402–405 are spaced at 90° intervals around the inner surface of the housing 326 and are connected by way of cable 408 to the electronic controller 342. As the drill stem rotates, the magnet passes the sensors, with the strength of the detected magnetic field being proportional to the distance between the magnet and the sensor coil. One pair of opposed sensors measures X-axis deflection and the other pair measures Y-axis deflection. The resulting four output signals per revolution of the drill stem permit an accurate measure of the bend in the drill stem, and this can be used as a feedback control to regulate the operation of the actuator, as described above.

If no deflection is applied to the drill stem by the actuator, so the drill stem would be coaxial with the housing 24, for example, then the four spaced magnetic field sensors can be used to measure the curvature of the borehole, since that curvature will itself apply a bending force to the drill stem and cause it to deflect within the actuator housing. This curvature is commonly known as "dogleg severity", and is an extremely important drilling parameter because it measures the deviation of the borehole, and thus the change in course of the drilling, over the length of the housing.

The controller 342 illustrated in FIG. 21 may be connected through the data link 298, including coils 300 and 302, for communication with the surface by way of mud pulser 304, as described above. Alternatively, communication within the borehole can be carried out by connecting the electronic controller 342 to an electrode 420 (FIG. 20) mounted on the exterior surface of housing 326 for injecting signaling currents into the earth formation in which the borehole is being drilled. The injected current is detected by a pickup electrode 422 or the coil 302 on the drill string 10 at a location spaced above the actuator housing 326 for driving the mud pulser 304, as discussed above. An injected current of 10 mA at 10 kHz will provide suitable down hole communication.

The drill stem and bit may be sized to drill a borehole 14 having a diameter of 8⅝". In this case, the housing 24 (or 326) may have an outer diameter of about 7 inches and may be approximately 18 feet long. The distance between support bearing 34 and the actuator 50 may be approximately 10'. The drill stem 10 may have an outer diameter of 3.5" and an inner diameter of 2.5" at its upper end (as viewed in FIG. 2), and may have an outer diameter of 4" below the housing 24 in order to provide added stiffness which will maintain the curvature imposed by the actuator 50.

Although the invention has been described in terms of preferred embodiment, it will be apparent that variations and modifications may be made without departing from the true spirit and scope thereof.

What is claimed is:

1. A controller for directional drilling of a borehole, comprising:

an elongated housing secured in the borehole being drilled, said housing having an axis generally coaxial with said borehole;

a drill stem extending through said housing and having an axis generally coaxial with the axis of said housing, said drill stem carrying a drilling head for drilling said borehole;

an actuator within said housing, said actuator including axially spaced actuator sets of coaxial eccentric cams interconnected in pairs and mounted on said drill stem;

control apparatus selectively operable to cause at least a first set of said cams to engage said housing to bend said drill stem axis with respect to said housing axis to produce a curvature in said drill stem and operable to cause a second set of said cams to be disengaged from said housing, the disengaged cams being rotatable with respect to the engaged cams to control the direction of curvature of said drill stem; and a controller circuit selectively operating said control apparatus to rotate a disengaged cam in a pair of interconnected cam with respect to the engaged cam in said pair to select the direction of bending of said drill stem axis to thereby control the direction of drilling of said borehole.

2. The controller of claim 1, further including a detector located to be responsive to the bending of said drill stem to produce feedback control signals for said controller circuit.

3. The controller of claim 1, further including a detector responsive to the operation of said actuator to produce feedback control signals for said controller circuit.

4. The controller of claim 1, wherein each of said sets of cams each include plural coaxial, eccentric cams mounted within said housing for rotation about the axis of said drill stem, said cams being individually operable by said control apparatus to cause a selected cam to engage said housing to control the direction of bend in said drill stem.

5. The controller of claim 4, wherein said control apparatus includes a power take off assembly selectively connectable between said drill stem and a selected eccentric cam by said controller circuit, rotation of said drill stem driving said assembly.

6. The controller of claim 5, wherein said control apparatus further includes a clutch for selectively connecting said power takeoff assembly to said selected cam.

7. The controller of claim 5, wherein said control apparatus further includes individual clutches for connecting said power takeoff to corresponding cams, said controller circuit selectively connecting each cam of a pair of cams to said power takeoff through a corresponding clutch.

8. The controller of claim 5, wherein said control apparatus further includes a drive tube surrounding said drill stem for connecting said power takeoff assembly to a corresponding eccentric cam.

9. The controller of claim 4, wherein a first pair of said cams is fixed to said drill stem at a midpoint in said housing.

10. The controller of claim 9, wherein a second pair of said cams is rotatably mounted on said first pair of cams.

11. The controller of claim 10, wherein a third pair of said cams is rotatably mounted on said second pair of cams.

12. The controller of claim 11, wherein said first pair of cams includes first and second lobes axially spaced along said drill stem, said first lobe being 180° out of phase from said second lobe.

13. The controller of claim 12, wherein said second pair of cams includes third and fourth cams each having a lobe and being mounted on, and rotatable around, said first and second cams, respectively, said third cam having limited relative rotation with respect to said fourth cam.

14. The controller of claim 13, wherein said third pair of cams includes fifth and sixth cams each having a lobe and being mounted on, and rotatable around, said third and fourth cams, respectively, said fifth cam having limited relative rotation with respect to said sixth cam.

15. The controller of claim 14, wherein said third cam is linked to said fourth cam to limit angular rotation of said third cam with respect to said fourth cam to about 3°.

16. The controller of claim 15, wherein said fifth cam is linked to said sixth cam to limit angular rotation of said fifth cam with respect to said sixth cam to about 3°.

17. The controller of claim 16, wherein said fifth and sixth cams each includes an outer cam surface comprising plural spaced, axially extending fingers, said fingers of said fifth cam being interdigitated with said fingers of said sixth cam to link said cams.

18. The controller of claim 1, further including an electrical alternator having a rotor driven by said drill stem and a stator secured to said housing.

19. The controller of claim 1, further including an electrical alternator having a rotor driven by said drill stem and a stator secured to said housing, wherein said rotor comprising a plurality of permanent magnets on said drill stem and said stator comprises a plurality of fixed coils adjacent said magnets.

20. A controller of claim 1, further including an electrical alternator having a rotor driven by said drill stem and a stator secured to said housing, wherein said rotor is mounted on a flywheel and is driven by said drill stem through an overriding clutch.

21. The controller of claim 1, further including an oil seal assembly at each end of said housing for mounting said housing on said drill stem.

22. The controller of claim 21, wherein each oil seal incorporates a floating sleeve mounted on said housing and engaging a sealing ring mounted on said drill stem.

23. The controller of claim 22, further including pressure equalization means within said housing.

24. The controller of claim 1, wherein said actuator includes at least two pairs of relatively rotatable eccentric cams connected through drive tubes to said control apparatus.

25. A controller for directional drilling of a borehole, comprising:

an elongated housing secured in the borehole being drilled, said housing having an axis generally coaxial with said borehole;

a drill stem extending through said housing and having an axis generally coaxial with the axis of said housing, said drill stem carrying a drilling head for drilling said borehole;

an actuator within said housing, said actuator including axially spaced actuator sets of coaxial eccentric cams interconnected in pairs and mounted on said drill stem;

control apparatus selectively operable to cause at least a first set of said cams to engage said housing to bend said drill stem axis with respect to said housing axis to produce a curvature in said drill stem and operable to cause a second set of said cams to be disengaged from said housing, the disengaged cams being rotatable with respect to the engaged cams to control the direction of curvature of said drill stem;

a control circuit responsive to a sensor in said housing for selectively operating said control apparatus; and wherein said control apparatus includes a power takeoff on said drill stem and clutches selectable for connecting said actuator to said power takeoff.

26. The controller of claim 25, further including a communications link connected to said control circuit for communicating with a remote location.

27. The controller of claim 26, wherein said link includes a first coil surrounding said drill stem within said housing, and a second coil surrounding said drill stem outside said housing.

28. The controller of claim 25, wherein said sensor is a counter for detecting the rotation of said drill stem.

* * * * *